US009921498B2

(12) United States Patent
Sekido et al.

(10) Patent No.: US 9,921,498 B2
(45) Date of Patent: Mar. 20, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kunihiko Sekido, Suntou-gun (JP); Masashi Nishi, Susono (JP); Michiyo Sekiya, Atami (JP); Kei Tagami, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/186,749

(22) Filed: Jun. 20, 2016

(65) Prior Publication Data

US 2016/0377998 A1 Dec. 29, 2016

(30) Foreign Application Priority Data

Jun. 25, 2015 (JP) ..... 2015-128103

(51) Int. Cl.

| | |
|---|---|
| ***G03G 5/14*** | (2006.01) |
| ***G03G 5/04*** | (2006.01) |
| ***G03G 15/00*** | (2006.01) |
| ***G03G 21/18*** | (2006.01) |

(52) U.S. Cl.

CPC ..... *G03G 5/04* (2013.01); *G03G 5/142* (2013.01); *G03G 15/75* (2013.01); *G03G 21/18* (2013.01)

(58) Field of Classification Search

CPC ..... G03G 5/142

See application file for complete search history.

(56) References Cited

U.S. PATENT DOCUMENTS

| | | | | |
|---|---|---|---|---|
| 5,455,135 | A | 10/1995 | Maruyama et al. | |
| 5,604,061 | A | 2/1997 | Sekido et al. | |
| 6,110,628 | A | 8/2000 | Sekiya et al. | |
| 6,228,546 | B1 | 5/2001 | Kashizaki et al. | |
| 6,372,397 | B1 | 4/2002 | Maruyama et al. | |
| 6,436,597 | B2 | 8/2002 | Maruyama et al. | |
| 6,664,014 | B1 | 12/2003 | Kikuchi et al. | |
| 6,866,977 | B2 * | 3/2005 | Sorriero | C08G 73/1082 430/64 |
| 7,141,341 | B2 | 11/2006 | Sekido et al. | |
| 7,378,205 | B2 | 5/2008 | Sekiya et al. | |
| 8,343,699 | B2 | 1/2013 | Nagasaka et al. | |
| 8,465,889 | B2 | 6/2013 | Sekido et al. | |
| 8,524,430 | B2 | 9/2013 | Takagi et al. | |
| 8,546,050 | B2 | 10/2013 | Maruyama et al. | |
| 8,632,931 | B2 | 1/2014 | Sekido et al. | |
| 8,795,936 | B2 | 8/2014 | Sekido et al. | |
| 9,029,054 | B2 | 5/2015 | Okuda et al. | |
| 9,063,505 | B2 | 6/2015 | Sekiya et al. | |
| 9,069,267 | B2 | 6/2015 | Kaku et al. | |
| 9,164,406 | B2 | 10/2015 | Nishi et al. | |
| 9,207,550 | B2 | 12/2015 | Okuda et al. | |
| 9,280,072 | B2 | 3/2016 | Ogaki et al. | |
| 9,335,645 | B2 | 5/2016 | Tagami et al. | |
| 2014/0004454 | A1 * | 1/2014 | Okuda | G03G 5/0605 430/56 |
| 2015/0099218 | A1 | 4/2015 | Murakami et al. | |
| 2015/0185630 | A1 | 7/2015 | Ito et al. | |
| 2015/0185632 | A1 | 7/2015 | Sekido et al. | |
| 2015/0185634 | A1 | 7/2015 | Sekiya et al. | |
| 2015/0185636 | A1 * | 7/2015 | Sekiya | G03G 5/142 430/56 |
| 2015/0185637 | A1 | 7/2015 | Nishi et al. | |
| 2015/0185638 | A1 | 7/2015 | Nakamura et al. | |
| 2016/0116853 | A1 | 4/2016 | Sekiya et al. | |
| 2016/0377999 | A1 * | 12/2016 | Nishi | G03G 5/142 430/56 |
| 2016/0378000 | A1 * | 12/2016 | Nishi | G03G 5/142 430/56 |
| 2016/0378001 | A1 * | 12/2016 | Nishi | G03G 5/142 430/56 |

FOREIGN PATENT DOCUMENTS

| | | |
|---|---|---|
| JP | 2001-083726 | 3/2001 |
| JP | 2003-345044 | 12/2003 |
| JP | 2008-065173 | 3/2008 |

OTHER PUBLICATIONS

"Crosslinking Agent Handbook" edited by Shinzo Yamashita and Tosuke Kaneko, and published by Taiseisha Ltd. (1981) 537-605.

Kaiser, et al., Chemische Berichte, vol. 124 (1991) 529-35.

Zheng, et al., "Pyromelletic Diimides: Minimal Cores for High Mobility n-Channel Transistor Semiconductors", Journal of American Chemical Society, vol. 130 (2008) 14410-11.

U.S. Appl. No. 15/077,209, filed Mar. 22, 2016, Kunihiko Sekido.
U.S. Appl. No. 15/169,418, filed May 31, 2016, Masashi Nishi.
U.S. Appl. No. 15/184,073, filed Jun. 16, 2016, Masashi Nishi.
U.S. Appl. No. 15/184,100, filed Jun. 16, 2016, Masashi Nishi.

* cited by examiner

*Primary Examiner* — Christopher D Rodee

(74) *Attorney, Agent, or Firm* — Fitzpatrick Cella Harper and Scinto

(57) ABSTRACT

Provided is an electrophotographic photosensitive member including a support, an undercoat layer formed on the support, and a photosensitive layer formed on the undercoat layer, in which the undercoat layer contains a polymer of a composition containing a compound represented by the formula (1).

Formula (1)

5 Claims, 1 Drawing Sheet

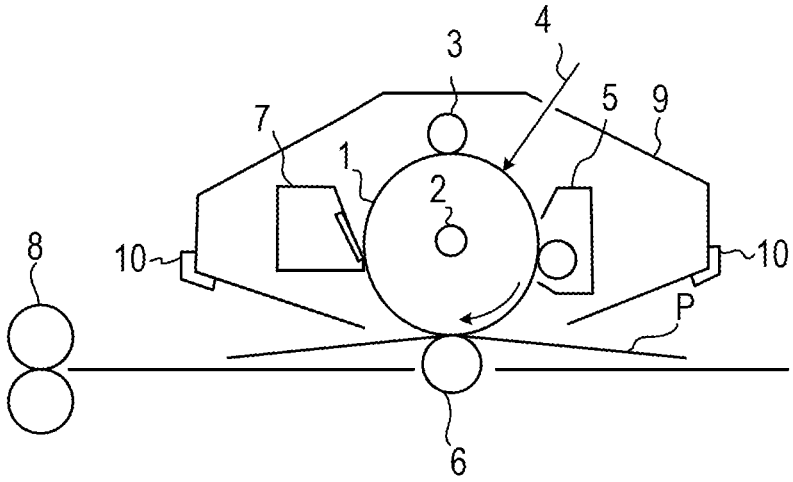
4
3
5
9
7
1
2
8
10
10
P
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus each including the electrophotographic photosensitive member.

Description of the Related Art

An electrophotographic photosensitive member containing an organic photoconductive material (charge generating material) has been mainly used as an electrophotographic photosensitive member to be mounted onto a process cartridge or an electrophotographic apparatus. The electrophotographic photosensitive member generally includes a support and a photosensitive layer formed on the support. Further, an undercoat layer is often formed between the support and the photosensitive layer.

A requirement for image quality has been continuing to grow in recent years. For example, an allowable range for color reproducibility has started to become much narrower.

The light portion potential of the electrophotographic photosensitive member is one important factor for the color reproducibility. In particular, when the potential largely fluctuates at the time of output on a large number of sheets, the color reproducibility changes and hence the image quality reduces.

Not only at the time of full-color output but also at the time of monochrome output, the fluctuation in potential causes, for example, a change in density of a halftone image and hence leads to the reduction in image quality.

A technology involving incorporating an electron transporting material into the undercoat layer has been known as a technology for the suppression (reduction) of such fluctuation in potential at the time of the output on a large number of sheets.

In each of, for example, Japanese Patent Application Laid-Open No. 2001-83726, Japanese Patent Application Laid-Open No. 2003-345044, and Japanese Patent Application Laid-Open No. 2008-65173 as the technology involving incorporating the electron transporting material into the undercoat layer, there is a disclosure of a technology involving incorporating the electron transporting material, such as a fluorenone compound derivative, an imide compound derivative, or an anthraquinone derivative, into the undercoat layer.

SUMMARY OF THE INVENTION

According to one embodiment of the present invention, there is provided an electrophotographic photosensitive member, including:

a support;

an undercoat layer formed on the support; and a photosensitive layer formed on the undercoat layer, in which the undercoat layer contains a polymer of a composition containing a compound represented by the formula (1).

Formula (1)

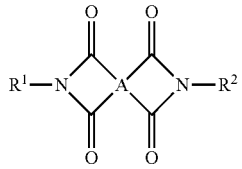

In the formula (1), $R^1$ represents a substituted or unsubstituted alkyl group having 1 to 6 carbon atoms in a main chain thereof, or a substituted or unsubstituted aryl group, the alkyl group or the aryl group having 2 or more polymerizable functional groups, and the polymerizable functional groups each include a hydroxy group, a thiol group, an amino group, or a carboxyl group.

In the formula (1), $R^2$ represents a substituted or unsubstituted alkyl group having 1 to 6 carbon atoms in a main chain thereof, a group derived by substituting at least one $CH_2$ in a main chain of a substituted or unsubstituted alkyl group having 3 to 6 carbon atoms in the main chain with an oxygen atom, a group derived by substituting at least one $CH_2$ in a main chain of a substituted or unsubstituted alkyl group having 3 to 6 carbon atoms in the main chain with a sulfur atom, a group derived by substituting at least one $CH_2$ in a main chain of a substituted or unsubstituted alkyl group having 3 to 6 carbon atoms in the main chain with $NR^3$, a group derived by substituting at least one $CH_2$ in a main chain of a substituted or unsubstituted alkyl group having 2 to 6 carbon atoms in the main chain with a carbonyl group, a group derived by substituting at least one $C_2H_4$ in a main chain of a substituted or unsubstituted alkyl group having 3 to 6 carbon atoms in the main chain with COO, a substituted or unsubstituted cyclic alkyl group having 3 to 6 carbon atoms in a main chain thereof, or a substituted or unsubstituted aryl group.

In the formula (1), $R^3$ represents a hydrogen atom or an alkyl group having 1 to 6 carbon atoms in a main chain thereof.

A substituent of each of the alkyl group, the group derived by substituting at least one $CH_2$ in the main chain of an alkyl group with an oxygen atom, a sulfur atom, $NR^3$, or a carbonyl group, or the group derived by substituting at least one $C_2H_4$ in the main chain with COO, and the cyclic alkyl group includes an alkyl group having 1 to 6 carbon atoms, benzyl group, alkoxycarbonyl group, or phenyl group that may be further substituted.

A substituent of the aryl croup includes a halogen atom, a cyano group, a nitro group, or an alkyl group, alkoxy group, or alkoxycarbonyl group having 1 to 6 carbon atoms that may be further substituted.

In the formula (1), A represents a structure represented by the formula (2) or the formula (3).

Formula (2)

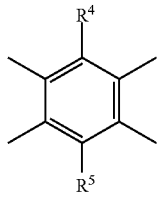

-continued

Formula (3)

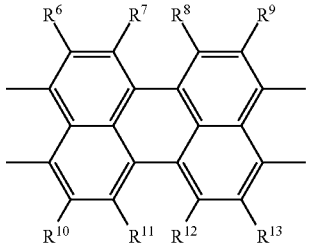

In the formula (2) and the formula (3), $R^4$ to $R^{13}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group.

According to one embodiment of the present invention, there is provided a process cartridge, including: the electrophotographic photosensitive member; and at least one unit selected from the group consisting of a charging unit, a developing unit, a transferring unit, and a cleaning unit, the process cartridge integrally supporting the electrophotographic photosensitive member and the at least one unit, the process cartridge being removably mounted onto a main body of an electrophotographic apparatus.

According to one embodiment of the present invention, there is provided an electrophotographic apparatus, including: the electrophotographic photosensitive member; a charging unit; an exposing unit; a developing unit; and a transferring unit.

Further features of the present invention will become apparent from the following description of exemplary embodiments with reference to the attached drawings.

BRIEF DESCRIPTION OF THE DRAWINGS

FIGURE is a view for illustrating the schematic construction of an electrophotographic apparatus including a process cartridge including an electrophotographic photosensitive member of the present invention.

DESCRIPTION OF THE EMBODIMENTS

Preferred embodiments of the present invention will now be described in detail in accordance with the accompanying drawing.

The inventors of the present invention have made investigations, and as a result, have found that the related art is still susceptible to improvement in terms of a fluctuation (deterioration) in potential after continuous image output as compared with a potential before the output.

An object of the present invention is to provide an electrophotographic photosensitive member suppressed in fluctuation in potential after continuous image output as compared with a potential before the output, and a process cartridge and an electrophotographic apparatus each including the electrophotographic photosensitive member.

The inventors of the present invention have made extensive investigations, and as a result, have found that the suppression of a fluctuation in potential after continuous image output as compared with a potential before the output can be achieved at a high level by incorporating a polymer of a compound having a specific structure into the undercoat layer of an electrophotographic photosensitive member.

An electrophotographic photosensitive member of the present invention includes: a support; an undercoat layer formed on the support; and a photosensitive layer formed on the undercoat layer and containing a charge generating material and a hole transporting material. In the electrophotographic photosensitive member, the undercoat layer contains a polymer of a composition containing a compound represented by the formula (1).

Formula (1)

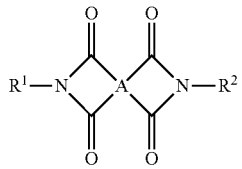

In the formula (1), $R^1$ represents a substituted or unsubstituted alkyl group having 1 to 6 carbon atoms in a main chain thereof, or a substituted or unsubstituted aryl group, the alkyl group or the aryl group having 2 or more polymerizable functional groups, and the polymerizable functional groups are each a hydroxy group, a thiol group, an amino group, or a carboxyl group.

$R^2$ represents a substituted or unsubstituted alkyl group having 1 to 6 carbon atoms in a main chain thereof, a group derived by substituting at least one $CH_2$ in a main chain of a substituted or unsubstituted alkyl group having 3 to 6 carbon atoms in the main chain with an oxygen atom, a group derived by substituting at least one $CH_2$ in a main chain of a substituted or unsubstituted alkyl group having 3 to 6 carbon atoms in the main chain with a sulfur atom, a group derived by substituting at least one $CH_2$ in a main chain of a substituted or unsubstituted alkyl group having 3 to 6 carbon atoms in the main chain with $NR^3$, a group derived by substituting at least one $CH_2$ in a main chain of a substituted or unsubstituted alkyl group having 2 to 6 carbon atoms in the main chain with a carbonyl group, a group derived by substituting at least one $C_2H_4$ in a main chain of a substituted or unsubstituted alkyl group having 3 to 6 carbon atoms in the main chain with COO, a substituted or unsubstituted cyclic alkyl group having 3 to 6 carbon atoms in a main chain thereof, or a substituted or unsubstituted aryl group. However, in the group derived by substituting at least one $CH_2$ in the main chain of an alkyl group with an oxygen atom, a sulfur atom, or $NR^3$, none of the oxygen atom, the sulfur atom, and the $NR^3$ is directly bonded to a nitrogen atom to which $R^2$ is bonded.

$R^3$ represents a hydrogen atom, or a substituted or unsubstituted alkyl group having 1 to 6 carbon atoms in a main chain thereof.

A substituent of each of the alkyl group, the group derived by substituting at least one $CH_2$ in the main chain of an alkyl group with an oxygen atom, a sulfur atom, NR, or a carbonyl group, the group derived by substituting at least one $C_2H_4$ in the main chain of an alkyl group with COO, and the cyclic alkyl group is an alkyl group having 1 to 6 carbon atoms, benzyl group, alkoxycarbonyl group, or phenyl group that may be further substituted.

A substituent of the aryl group is a halogen atom, a cyano group, a nitro group, or an alkyl group, alkoxy group, or alkoxycarbonyl group having 1 to 6 carbon atoms that may be further substituted.

A represents a structure represented by the formula (2) or the formula (3).

Formula (2)

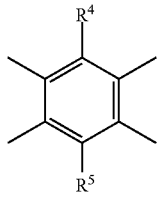

Formula (3)

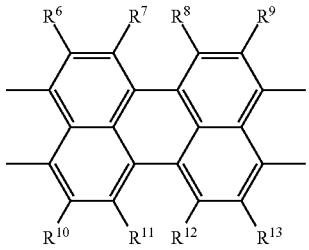

In the formula (2) and the formula (3), to each independently represent a hydrogen atom, a halogen atom, a cyano group, a nitro group, a substituted or unsubstituted alkyl group having 1 to 6 carbon atoms in a main chain thereof, or a substituted or unsubstituted aryl group.

In the compound represented by the formula (1), the alkyl group having 1 to 6 carbon atoms in a main chain thereof serving as any one of $R^1$ to $R^{13}$ is a linear alkyl group or a branched alkyl group, and examples thereof include, but not limited to, a methyl group, an ethyl group, a propyl group, an isopropyl group, a n-butyl group, a s-butyl group, a t-butyl group, an isobutyl group, a n-pentyl group, a pentan-2-yl group, a pentan-3-yl group, a 2-methylbutyl group, a 2-methylbutan-2-yl group, a 3-methylbutan-2-yl group, a 3-methylbutyl group, a 2,2-dimethylpropyl group, a n-hexyl group, a hexan-2-yl group, a hexan-3-yl group, a 2-methylpentyl group, a 2-methylpentan-1-yl group, a 2-methylpentan-3-yl group, a 4-methylpentan-2-yl group, a 3-methylpentyl group, a 4-methylpentyl group, a 3-methylpentan-2-yl group, a 3-methylpentan-3-yl group, a 2,2-dimethylbutyl group, a 3,3-dimethylbutan-2-yl group, a 3,3-dimethylbutyl group, a 2,3-dimethylbutyl group, a 2,3-dimethylbutan-2-yl group, and a 3,3-dimethylbutan-2-yl group.

Examples of the substituent of the alkyl group having 1 to 6 carbon atoms include, but not limited to, an alkyl group, an alkoxycarbonyl group, a benzyl group, and a phenyl group. Examples of the alkyl group serving as the substituent include the same groups as the substituent of the alkyl group having 1 to 6 carbon atoms. In addition, the alkoxycarbonyl group serving as the substituent is a group having bonded thereto the alkyl group serving as the substituent through oxycarbonyl (OCO). Further, the alkyl group having 1 to 6 carbon atoms may be substituted with one of those substituents alone, or may be simultaneously substituted with two or more of the substituents. Alternatively, the substituents may each be further substituted with any other of the substituents.

In the compound represented by the formula (1), examples of the aryl group serving as any one of $R^1$, $R^2$, and $R^4$ to $R^{13}$ include, but not limited to, a phenyl group, a naphthyl group, a fluorenyl group, an anthranyl group, and a phenanthrenyl group.

Examples of the substituent of the aryl group include, but not limited to, a halogen atom, a cyano group, a nitro group, an alkyl group, an alkoxy group, and an alkoxycarbonyl group. Examples of the halogen atom serving as the substituent can include fluorine, chlorine, bromine, and iodine. In addition, examples of the alkyl group serving as the substituent include the same groups as the alkyl group having 1 to 6 carbon atoms. Further, the alkoxy group serving as the substituent is a group having bonded thereto the alkyl group serving as the substituent through an oxygen atom. Further, the alkoxycarbonyl group serving as the substituent is a group having bonded thereto the alkoxy group serving as the substituent through a carbonyl (CO) group. The aryl group may be substituted with one of those substituents alone, or may be simultaneously substituted with two or more of the substituents, and the alkyl group, the alkoxycarbonyl group, or the alkoxy group may be further substituted with any other of the substituents.

In the compound represented by the formula (1), examples of the group derived by substituting at least one $CH_2$ in the main chain of an alkyl group having 3 to 6 carbon atoms in the main chain with an oxygen atom serving as $R^2$ include a methoxymethyl group, an ethoxymethyl group, a 1-methoxyethyl group, a 2-methoxyethyl group, a methoxypropyl group, a 2-ethoxyethyl group, a n-propoxymethyl group, an isopropoxymethyl group, a 1-methyl-2-methoxyethyl group, a 1-ethoxyethyl group, a 2-methoxypropyl group, a 1-methyl-1-methoxyethyl group, a 1-methoxypropyl group, a 4-methoxybutyl group, a 3-ethoxypropyl group, a 2-n-propoxyethyl group, a n-butoxymethyl group, a 1-methyl-3-methoxypropyl group, a 1-methyl-2-ethoxyethyl group, a 1-n-propoxyethyl group, a 2-methyl-3-methoxypropyl group, a 2-ethoxypropyl group, a 3-methoxybutyl group, a s-butoxymethyl group, a 1-isopropoxyethyl group, a 2-isopropoxyethyl group, an isobutoxymethyl group, a 1,1-dimethyl-1-ethoxymethyl group, a 1,1-dimethyl-1-methoxyethyl group, a 1,2-dimethyl-2-methoxyethyl group, a 2,2-dimethyl-2-methoxyethyl group, a t-butoxymethyl group, a 1-methoxybutyl group, a 2-ethoxypropyl group, a 1-methoxymethylpropyl group, a 1-methyl-1-methoxypropyl group, a 2-methyl-1-methoxypropyl group, a methoxymethoxymethyl group, a 2-(methoxymethoxy)ethyl group, a (1-methoxyethoxy)methyl group, a (2-methoxyethoxy)methyl group, an ethoxymethoxymethyl group, a 1-(methoxymethoxy)ethyl group, a dimethoxymethyl group, an ethoxymethoxymethyl group, a 1,1-dimethoxyethyl group, and a 1,2-dimethoxyethyl group.

In the compound represented by the formula (1), examples of the group derived by substituting at least one $CH_2$ in the main chain of an alkyl group having 3 to 6 carbon atoms in the main chain with a sulfur atom serving as $R^2$ include a methylthiomethyl group, an ethylthiomethyl group, a 1-methylthioethyl group, a 2-methylthioethyl group, a 3-methylthiopropyl group, a 2-ethylthioethyl group, a n-propylthiomethyl group, an isopropylthiomethyl group, a 1-methyl-2-methylthioethyl group, a 1-ethylthioethyl group, a 2-methylthiopropyl group, a 1-methyl-1-methylthioethyl group, a 1-methylthiopropyl group, a 4-methylthiobutyl group, a 3-ethylthiopropyl group, a 2-n-propylthiomethyl group, a n-butylthiomethyl group, a 1-methyl-3-methylthiopropyl group, a 1-methyl-2-ethylthioethyl group, a 1-n-propylthiomethyl group, a 2-methyl-3-methylthiopropyl group, a 2-ethylthiopropyl group, a 3-methylthiobutyl group, a s-butylthiomethyl group, a 1-isopropylthioethyl group, a 2-isopropylthioethyl group, an isobutylthioethyl group, a 1,1-dimethyl-1-ethylthiomethyl group, a 1,1-dimethyl-1-methylthioethyl group, a 1,2-dimethyl-2-methylthioethyl group, a 2,2-dimethyl-2-methylthioethyl group, a t-butylthiomethyl group, a 1-methylthiobutyl group, a 2-ethylthiopropyl group, a 1-methylthiomethylpropyl group, a 1-methyl-1-methylthiopropyl group, a 2-methyl-1-methylthiopropyl group, a methylthiomethylthiomethyl group, a 2-(methylthiomethylthio)ethyl group, a (1-methylthioethylthio)methyl group, a (2-methylthioethylthio)methyl group, an ethylthiomethylthiomethyl group, a 1-(methylthiomethylthio)ethyl group, a dimethylthiomethyl group, an ethylthiomethylthiomethyl group, a 1,1-dimethylthioethyl group, and a 1,2-dimethylthioethyl group.

In the compound represented by the formula (1), examples of the group derived by substituting at least one $CH_2$ in the main chain of an alkyl group having 3 to 6 carbon atoms in the main chain with $NR^3$ serving as $R^2$ include a (methyl$R^3$amino)methyl group, an (ethyl$R^3$amino)methyl group, a 1-(methyl$R^3$amino)ethyl group, a 2-(methyl$R^3$amino)ethyl group, a 3-(methyl$R^3$amino) propyl group, a 2-(ethyl$R^3$amino)ethyl group, a (n-propyl$R^3$amino)methyl group, an (isopropyl$R^3$amino) methyl group, a 1-methyl-2-(methyl$R^3$amino)ethyl group, a 1-(ethyl$R^3$amino)ethyl group, a 2-(methyl$R^3$amino) propyl group, a 1-methyl-1-(methyl$R^3$amino)ethyl group, a 1-(methyl$R^3$amino) propyl group, a 4-(methyl$R^3$amino)butyl group, a 3-(ethyl$R^3$amino) propyl group, a 2-(n-propyl$R^3$amino)ethyl group, a (n-butyl$R^3$amino)methyl group, a 1-methyl-3-(methyl$R^3$amino)propyl group, a 1-methyl-2-(ethyl$R^3$amino)ethyl group, a 1-(n-propyl$R^3$amino)ethyl group, a 2-methyl-3-(methyl$R^3$amino) propyl group, a 2-(ethyl$R^3$amino) propyl group, a 3-(methyl$R^3$amino)butyl group, a (s-butyl$R^3$amino)-methyl group, a 1-(isopropyl$R^3$amino)ethyl group, a 2-(isopropyl$R^3$amino)ethyl group, an (isobutyl$R^3$amino) methyl group, a 1,1-dimethyl-1-(ethyl$R^3$amino)methyl group, a 1,1-dimethyl-1-(methyl$R^3$amino)ethyl group, a 1,2-dimethyl-2-(methyl$R^3$amino)ethyl group, a 2,2-dimethyl-2-(methyl$R^3$amino)ethyl group, a (t-butyl$R^3$amino)methyl group, a 1-(methyl$R^3$amino)butyl group, a 2-(ethyl$R^3$amino) propyl group, a 1-(methyl$R^3$amino)methylpropyl group, a 1-methyl-1-(methyl$R^3$amino)propyl group, a 2-methyl-1-(methyl$R^3$amino)propyl group, a [(methyl$R^3$aminomethyl) $R^3$amino]methyl group, a 2-[(methyl$R^3$aminomethyl) $R^3$amino)]ethyl group, a [1-(methyl$R^3$aminoethyl) $R^3$amino]methyl group, a [2-(methyl$R^3$aminoethyl) $R^3$amino]methyl group, an [(ethyl$R^3$aminomethyl) $R^3$amino]methyl group, a 1-[(methyl$R^3$aminomethyl) $R^3$amino]ethyl group, a di(methyl$R^3$amino)methyl group, an [ethyl$R^3$aminomethyl) $R^3$amino]methyl group, a 1,1-di (methyl$R^3$amino)ethyl group, and a 1,2-di(methyl$R_3$amino) ethyl group.

In the compound represented by the formula (1), examples of the group derived by substituting at least one $CH_2$ in the main chain of an alkyl group having 2 to 6 carbon atoms in the main chain with a carbonyl group serving as $R^2$ include an acetyl group, an ethylcarbonyl group, an acetylmethyl group, a n-propylcarbonyl group, an ethylcarbonylmethyl group, a 2-acetylethyl group, an acetylacetyl group, a 1-acetylethyl group, an isopropylcarbonyl group, a n-butylcarbonyl group, a n-propylcarbonylmethyl group, a 2-ethylcarbonylethyl group, a 3-acetylpropyl group, an ethylcarbonylacetyl group, an acetylacetylmethyl group, a 2-acetylethylcarbonyl group, a 1-ethylcarbonylethyl group, a 1-acetylpropan-2-yl group, a 1-acetylpropyl group, a diacetylmethyl group, a s-butylcarbonyl group, a 2-acetylpropan-2-yl group, an isopropylcarbonylmethyl group, an isobutylcarbonyl group, a pivaloyl group, a n-pentylcarbonyl group, a n-butylcarbonylmethyl group, a 2-(n-propylcarbonyl)ethyl group, a 3-(ethylcarbonyl)propyl group, an acetylbutyl group, a n-propylcarbonylacetyl group, a 2-(ethylcarbonyl)ethylcarbonyl group, a 3-acetylpropylcarbonyl group, an ethylcarbonylacetylmethyl group, a 2-acetylethylcarbonylmethyl group, a 2-(acetylacetyl)ethyl group, a 1-(n-propylcarbonyl)ethyl group, a 1-(ethylcarbonylmethyl) ethyl group, a 1-(2-acetylethyl)ethyl group, a 1-(acetylacetyl)ethyl group, a 1-acetyl-n-butyl group, a 1-(ethylcarbonyl)-n-propyl group, a 1-acetyl-n-butan-2-yl group, a 1,1-acetylethylcarbonylmethyl group, a 1,2-diacetylethyl group, a 1-methylbutylcarbonyl group, a 2-ethylcarbonyl-n-propyl group, a 3-acetyl-2-methylpropyl group, a 1-ethylcarbonylethylcarbonyl group, a 2-acetyl-1-methylethylcarbonyl group, a 1-acetylisobutyl group, an isoamylcarbonyl group, an isobutylcarbonylmethyl group, a 2-isopropylcarbonylethyl group, an isopropylcarbonylacetyl group, a 2-methylbutylcarbonyl group, a s-butylcarbonylmethyl group, a 3-acetyl-n-butyl group, a 2-acetyl-n-propylcarbonyl group, a 1-acetylethylcarbonylmethyl group, a 1-isopropylcarbonylethyl group, a 2-ethylcarbonylpropan-2-yl group, a 2-(acetylmethyl)propan-2-yl group, a 3-acetylbutan-2-yl group, a 2-acetylbutan-2-yl group, a 1,1-diacetylethyl group, a 1,2-dimethylpropylcarbonyl group, a 1,1-dimethylpropylcarbonyl group, a 2-acetyl-2-methylpropyl group, a 1-acetyl-1-methylethylcarbonyl group, a t-butylacetyl group, and a pivaloylmethyl group.

In the compound represented by the formula (1), examples of the group derived by substituting at least one of $C_2H_4$ in the main chain of an alkyl group having 3 to 6 carbon atoms in the main chain with COO serving as R include: alkylcarbonyloxy groups, such as an acetyloxymethyl group, an ethylcarbonyloxymethyl group, a 2-acetyloxyethyl group, a 1-acetyloxyethyl group, a n-propylcarbonyloxymethyl group, a 2-ethylcarbonyloxyethyl group, a 3-acetyloxy-n-propyl group, a 1-ethylcarbonyloxyethyl group, a 1-acetyloxypropan-2-yl group, a 1-acetyloxy-n-propyl group, a 1,1-diacetyloxymethyl group, and a 2-acetyloxy-n-propyl group; and alkoxycarbonyl groups, such as a methoxycarbonyl group, an ethoxycarbonyl group, a methoxycarbonylmethyl group, a n-propoxycarbonyl group, an isopropoxycarbonyl group, an ethoxycarbonylmethyl group, a 2-methoxycarbonylethyl group, a 1-methoxycarbonylethyl group, a n-butoxycarbonyl group, a n-propoxycarbonylmethyi group, a 2-ethoxycarbonylethyl group, a 3-methoxycarbonyl-n-propyl group, a 1-ethoxycarbonylethyl group, a 1-methoxycarbonylpropan-2-yl group, a 1-methoxycarbonyl-n-propyl group, a 1,1-dimethoxycarbonyimethyl group, a s-butoxycarbonyl group, a 2-methoxycarbonyl-n-propyl group, a 2-methoxycarbonylpropan-2-yl group, an isobutoxycarbonyl group, a t-butoxycarbonyl group, and an isopropoxycarbonylmethyl group.

In the compound represented by the formula (1), examples of the cyclic alkyl group having 3 to 6 carbon atoms in a main chain thereof serving as $R^2$ include cyclopropane, cyclobutane, cyclopentane, and cyclohexane.

The same substituent as the substituent of the alkyl group having 1 to 6 carbon atoms and the substituent of the aryl group can be used as the substituent of each of: the group derived by substituting at least one $CH_2$ in the main chain of an alkyl group having 3 to 6 carbon atoms in the main chain with an oxygen atom; the group derived by substituting at least one $CH_2$ in the main chain of an alkyl group having 3 to 6 carbon atoms in the main chain with a sulfur atom; the group derived by substituting at least one $CH_2$ in the main chain of an alkyl group having 3 to 6 carbon atoms in the main chain with $NR^3$; the group derived by substituting at least one $CH_2$ in the main chain of an alkyl group having 2 to 6 carbon atoms in the main chain with a carbonyl group; the group derived by substituting at least one $C_2H_4$ in the main chain of a substituted or unsubstituted alkyl group having 3 to 6 carbon atoms in the main chain with COO; and the cyclic alkyl group having 3 to 6 carbon atoms in a main chain thereof.

[Support]

The support is preferably a support having electroconductivity (electroconductive support). Examples thereof include supports each made of a metal, such as aluminum, nickel, copper, gold, or iron, or an alloy thereof. The examples further include supports each obtained by forming, on an insulating support, such as a polyester, a polycarbonate, a polyimide, or a glass, a thin film of a metal, such as aluminum, silver, or gold, or a thin film of an electroconductive material, such as indium oxide or tin oxide.

The surface of the support may be subjected to an electrochemical treatment, such as anodization, or a treatment, such as wet honing, blasting, or cutting, in order that its electrical characteristics may be improved or interference fringes that are liable to occur at the time of irradiation with coherent light, such as a semiconductor laser, may be suppressed.

[Undercoat Layer]

The undercoat layer is arranged between the photosensitive layer and the support.

The undercoat layer can be formed by: forming a coating film of a coating liquid for an undercoat layer containing the composition containing the compound represented by the formula (1); and drying the coating film. At the time of the drying of the coating film of the coating liquid for an undercoat layer, the compound represented by the formula (1) polymerizes, and in that case, the polymerization reaction (curing reaction) is accelerated by applying thermal or optical energy.

In the present invention, the composition containing the compound represented by the formula (1) preferably contains a crosslinking agent. In addition, the composition containing the compound represented by the formula (1) preferably contains the crosslinking agent and a resin having a polymerizable functional group.

A compound that polymerizes (cures) or crosslinks with the compound represented by the formula (1) can be used as the crosslinking agent. Specifically, for example, a compound described in "Crosslinking Agent Handbook" edited by Shinzo Yamashita and Tosuke Kaneko, and published by Taiseisha Ltd. (1981) can be used.

A mass ratio between the crosslinking agent and the compound represented by the formula (1), which may adopt any value, is preferably from 100:50 to 100:250 out of such values.

When the mass ratio falls within the range, the following situation is conceivable: the aggregation of the molecules of the crosslinking agent is suppressed, and as a result, the number of trap sites in the undercoat layer reduces and a suppressing effect on a fluctuation in potential is further improved. The content of the resin having a polymerizable functional group in the undercoat layer is preferably from 3 mass % to 60 mass %, more preferably from 5 mass % to 20 mass % with respect to the total mass of the composition of the undercoat layer.

Examples of the crosslinking agent include an isocyanate compound and an amine compound.

The isocyanate compound is preferably an isocyanate compound having a plurality of isocyanate groups or blocked isocyanate groups. Examples of the isocyanate compound include triisocyanatobenzene, triisocyanatomethylbenzene, triphenylmethane triisocyanate, lysine triisocyanate, and an isocyanurate modified product, biuret modified product, allophanate modified product, and trimethylolpropane or pentaerythritol adduct modified product of a diisocyanate, such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl 2,6-diisocyanatohexanoate, or norbornane diisocyanate. Of those, an isocyanurate modified product and an adduct modified product are more preferred.

As an isocyanate compound that can be generally purchased, there are given, for example, DURANATE MFK-60B or SBA-70B manufactured by Asahi Kasei Chemicals Corporation, and DESMODUR BL3175 or BL3475 manufactured by Sumika Bayer Urethane Co., Ltd.

The amine compound is preferably, for example, an amine compound having a plurality of N-methylol groups or alkyl-etherified N-methylol groups. Examples thereof include methylolated melamine, methylolated guanamine, a methylolated urea derivative, a methylolated ethylene urea derivative, methylolated glycoluril, and these compounds whose methylol sites are alkyl-etherified, and derivatives thereof.

As an amine compound that can be generally purchased, there are be given, for example, U-VAN 20SE60 or 220 manufactured by Mitsui Chemicals, Inc., and SUPER BECKAMINE L-125-60 or G-821-60 manufactured by DIC Corporation.

In addition to the isocyanate compound and the amine compound, examples of the crosslinking agent also include various compounds, such as triglycidyl isocyanurate and 2,6-bis(hydroxymethyl)-p-cresol.

A resin having a polymerizable functional group capable of polymerizing (curing) with any such crosslinking agent can be used as the resin. Preferred examples of the polymerizable functional group include a hydroxy group, a thiol group, an amino group, a carboxyl group, and a methoxy group. A resin having a structural unit represented by the following formula (4) is preferred as a thermoplastic resin having the polymerizable functional group.

Formula (4)

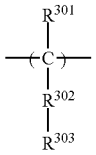

In the formula (4), $R^{301}$ represents a hydrogen atom or an alkyl group, $R^{32}$ represents a single bond, an alkylene group, or a phenylene group, and $R^{303}$ represents a hydroxy group, a thiol group, an amino group, or a carboxyl group.

Examples of the resin having the structural unit represented by the formula (4) include an acetal resin, a polyolefin resin, a polyester resin, a polyether resin, a polyamide resin, and a cellulose resin. The resin may have the structural unit represented by the formula (4) in a characteristic structure to be represented below, or may have the unit outside the characteristic structure. The characteristic structure is represented by each of the following formulae (S-1) to (S-6). The formula (S-1) represents a structural unit of the acetal resin. The formula (S-2) represents a structural unit of the polyolefin resin. The formula (S-3) represents a structural unit of the polyester resin. The formula (S-4) represents a structural unit of the polyether resin. The formula (S-5) represents a structural unit of the polyamide resin. The formula (S-6) represents a structural unit of the cellulose resin.

(S-1)

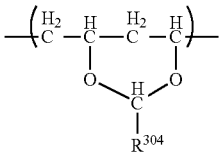

(S-2)

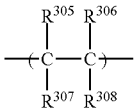

(S-3)

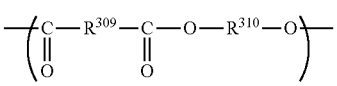

(S-4)

(S-5)

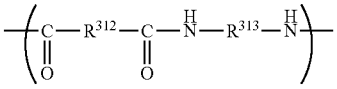

(S-6)

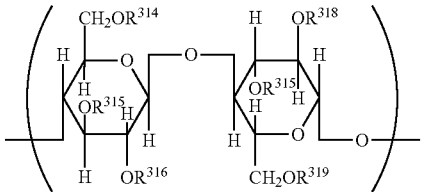

In the formulae, $R^{304}$ to $R^{308}$ each independently represent a substituted or unsubstituted alkyl group, a substituted or unsubstituted aryl group, or a hydrogen atom. $R^{309}$ to $R^{313}$ each represent a substituted or unsubstituted alkylene group, or a substituted or unsubstituted arylene group.

$R^{314}$ to $R^{319}$ each represent an acetyl group, a hydroxyethyl group, a hydroxypropyl group, or a hydrogen atom.

Examples of the alkyl group serving as any one of $R^{301}$ and $R^{304}$ to $R^{308}$ in the formula (4), the structure (S-1), and the structure (S-2) include, but not limited to, a methyl group, an ethyl group, a n-propyl group, an isopropyl group, a n-butyl group, a s-butyl group, a t-butyl group, and an isobutyl group. In particular, the case where $R^{304}$ represents a n-propyl group ($C_3H_7$) is preferred because the structure (S-1) represents a butyral.

Examples of the aryl group serving as any one of $R^{304}$ to $R^{308}$ in the structure (S-1) and the structure (S-2) include, but not limited to, a phenyl group, a naphthyl group, a fluorenyl group, an anthranyl group, a phenanthrenyl group, and a biphenyl group.

Examples of the alkylene group serving as any one of $R^{302}$ and $R^{309}$ to $R^{313}$ in the formula (4), the structure (S-3), the structure (S-4), and the structure (S-5) include, but not limited to, a methylene group, an ethylene group, a propylene group, and a butylene group.

Examples of the arylene group serving as any one of $R^{309}$ to $R^{313}$ in the structure (S-3), the structure (S-4), and the structure (S-5) include, but not limited to, a phenylene group, a naphthylene group, a fluorenylene group, an anthranylene group, a phenanthrenylene group, and a biphenylene group.

Examples of a substituent of each of the alkyl group, the aryl group, the alkylene group, and the arylene group include a hydroxy group, a thiol group, an amino group, and a carboxyl group.

The resin having the structural unit represented by the formula (4) is obtained by polymerizing a monomer having a polymerizable functional group that can be purchased from, for example, Sigma-Aldrich Japan or Tokyo Chemical Industry Co., Ltd.

In addition, the resin having the structural unit represented by the formula (4) can be generally purchased. Examples of the resin that can be purchased include: a polyether polyol-based resin, such as AQD-457 or AQD-473 manufactured by Nippon Polyurethane Industry Co., Ltd., or SANNIX GP-400 or GP-700 manufactured by Sanyo Chemical Industries, Ltd.; a polyester polyol-based resin, such as PHTHALKYD W2343 manufactured by Hitachi Chemical Co., Ltd., WATERSOL S-118 or CD-520 or BECKOLITE M-6402-50 or M-6201-40IM manufactured by DIC Corporation, HARIDIP WH-1188 manufactured by Harima Chemicals, Inc., or ES3604 or ES6538 manufactured by Japan U-Pica Company Ltd.; a polyacrylic polyol-based resin, such as BURNOCK WE-300 or WE-304 manufactured by DIC Corporation; a polyvinyl alcohol-based resin, such as KURARAY POVAL PVA-203 manufactured by Kuraray Co., Ltd.; a polyvinyl acetal-based resin, such as BX-1 or BM-1 manufactured by Sekisui Chemical Co., Ltd.; a polyamide-based resin, such as TORESIN FS-350 manufactured by Nagase ChemteX Corporation; a carboxyl group-containing resin, such as AQUALIC manufactured by Nippon Shokubai Co., Ltd. or FINELEX SG2000 manufactured by Namariichi Co., Ltd.; a polyamine resin, such as LUCKAMIDE manufactured by DIC Corporation; and a polythiol resin, such as QE-340M manufactured by Toray Fine Chemicals Co., Ltd. Of those, a polyvinyl acetal-based resin, a polyester polyol-based resin, or the like is more preferred from the viewpoints of polymerizability and uniformity of an electron transporting layer.

The weight-average molecular weight (Mw) of the resin having the structural unit represented by the formula (4) more preferably falls within the range of from 600 to 400,000.

Examples of a method of quantifying the polymerizable functional group in the resin include the following methods: the titration of a carboxyl group with potassium hydroxide, the titration of an amino group with sodium nitrite, and the titration of a hydroxy group with acetic anhydride and potassium hydroxide. Further examples thereof include the titration of a thiol group with 5,5'-dithiobis(2-nitrobenzoic acid) and a calibration curve method involving obtaining the amount of the polymerizable functional group from the IR spectrum of a sample whose polymerizable functional group introduction ratio has been changed.

Specific examples of the resin are shown in Table 1. In Table 1, the column "Characteristic moiety" represents a structural unit represented by any one of the formulae (S-1) to (S-6), and a major structure of "Butyral" is "polyvinylbutyral", a major structure of "Polyolefin" is "polyethylene", a major structure of "Polyester" is "polybutylene succinate", a major structure of "Polyether" is "polyoxyphenylene", a major structure of "Cellulose" is "cellulose triacetate", a major structure of "Polyamide" is "polyhexamethylene adipamide", and a major structure of "Acetal" is "polyvinyl formal".

TABLE 1

| | Structure | | | Number of moles of functional | Characteristic | Molecular |
|---|---|---|---|---|---|---|
| | $R^{301}$ | $R^{302}$ | $R^{303}$ | group per 1 g | moiety | weight |
| B1 | H | Single bond | OH | 3.3 mmol | Butyral | $1 \times 10^5$ |
| B2 | H | Single bond | OH | 3.3 mmol | Butyral | $4 \times 10^4$ |
| B3 | H | Single bond | OH | 3.3 mmol | Butyral | $2 \times 10^4$ |
| B4 | H | Single bond | OH | 1.0 mmol | Polyolefin | $1 \times 10^5$ |
| B5 | H | Single bond | OH | 3.0 mmol | Polyester | $8 \times 10^4$ |
| B6 | H | Single bond | OH | 2.5 mmol | Polyether | $5 \times 10^4$ |
| B7 | H | Single bond | OH | 2.8 mmol | Cellulose | $3 \times 10^4$ |
| B8 | H | Single bond | COOH | 3.5 mmol | Polyolefin | $6 \times 10^4$ |
| B9 | H | Single bond | $NH_2$ | 1.2 mmol | Polyamide | $2 \times 10^5$ |
| B10 | H | Single bond | SH | 1.3 mmol | Polyolefin | $8 \times 10^3$ |
| B11 | H | Phenylene | OH | 2.8 mmol | Polyolefin | $6 \times 10^4$ |
| B12 | H | Single bond | OH | 3.0 mmol | Butyral | $7 \times 10^4$ |
| B13 | H | Single bond | OH | 2.9 mmol | Polyester | $2 \times 10^4$ |
| B14 | H | Single bond | OH | 2.5 mmol | Polyester | $6 \times 10^3$ |
| B15 | H | Single bond | OH | 2.7 mmol | Polyester | $8 \times 10^4$ |
| B16 | H | Single bond | COOH | 1.4 mmol | Polyolefin | $2 \times 10^5$ |
| B17 | H | Single bond | COOH | 2.2 mmol | Polyester | $9 \times 10^3$ |
| B18 | H | Single bond | COOH | 2.8 mmol | Polyester | $8 \times 10^2$ |
| B19 | $CH_3$ | Single bond | OH | 2.0 mmol | Polyester | $5 \times 10^3$ |
| B20 | $C_2H_5$ | Single bond | OH | 1.2 mmol | Polyolefin | $6 \times 10^2$ |
| B21 | H | Single bond | OH | 3.3 mmol | Butyral | $2.7 \times 10^5$ |
| B22 | H | Single bond | OH | 3.3 mmol | Butyral | $4 \times 10^5$ |
| B23 | H | Single bond | OH | 2.5 mmol | Acetal | $4 \times 10^5$ |

The undercoat layer may contain any other substance than the compound represented by the formula (1) for improving its film formability and electrical characteristics. The layer may contain, for example, a resin, an organic particle, an inorganic particle, or a leveling agent. However, the content of any such substance in the undercoat layer is preferably less than 50 mass %, more preferably less than 20 mass % with respect to the total mass of the undercoat layer.

The inventors of the present invention have assumed the reason why the electrophotographic photosensitive member including the undercoat layer of the present invention is excellent in suppression of a fluctuation in potential to be as described below.

In the present invention, in the compound represented by the formula (1) (electron transporting material), 2 or more hydrogen-bonding polymerizable functional groups, such as a hydroxy group and a carboxyl group, are present on one side of an aromatic moiety represented by A, and these hydrogen-bonding polymerizable functional groups are not present on the opposite side.

The inventors have considered that as a result of the foregoing, the hydrogen-bonding polymerizable functional groups on the one side interact with each other to enable the molecules of the electron transporting material to be present so that the molecules may be relatively close to each other.

The inventors have assumed that because of the foregoing, even at the time of printing on a large number of sheets, the stagnation of electron transportation is suppressed and hence the fluctuation in potential is suppressed. The inventors have considered that the effect becomes larger in a compound having a structure represented by the formula (3) than in a compound having a structure represented by the formula (2).

Further, the inventors have assumed that particularly an imide derivative having a branched alkyl group suppresses electron trapping due to the aggregation of the molecules of the electron transporting material because of its bulky structure, and hence can further suppress the stagnation of the electron transportation.

The compound represented by the formula (1) can be synthesized by using, for example, a known synthesis method described in Journal of American Chemical Society, 130, 14410-14411 (2008), or Chemische Berichte, 124, 529-535 (1991). The compound can be synthesized by, for example, a reaction between pyromellitic dianhydride or perylene tetracarboxylic dianhydride available from Tokyo Chemical Industry Co., Ltd., Sigma-Aldrich Japan K.K., or Johnson Matthey Japan Incorporated and a monoamine derivative.

In addition, in order that a polymerizable functional group (a hydroxy group, a carboxyl group, a thiol group, or an amino group) may be introduced into the compound represented by the formula (1), for example, a method involving directly introducing the curable functional group into the synthesized skeleton is available. In addition to the foregoing, a method involving introducing a structure having the curable functional group or a functional group that can serve as a precursor of the curable functional group into the main skeleton moiety of the compound represented by the formula (1) obtained by the above-mentioned method is available. Examples of such method include: a method involving introducing a functional group-containing aryl group into a halide of an imide derivative through the use of, for example, a cross-coupling reaction involving using a palladium catalyst and a base; a method involving introducing a functional group-containing alkyl group through the use of a cross-coupling reaction involving using a $FeCl_3$ catalyst and a base; and a method involving introducing a hydroxyalkyl group or a carboxyl group by lithiation of the halide and then causing an epoxy compound or $CO_2$ to act on the resultant. Further, a method involving using a pyromellitic anhydride derivative, a perylene tetracarboxylic dianhydride derivative, or a monoamine derivative having the curable functional group or a functional group that can serve as a precursor of the curable functional group as a raw material at the time of the synthesis of the imide derivative is available.

Specific examples of the compound represented by the formula (1) are shown in the following tables, but the present invention is not limited to these compounds. In addition, in the following specific examples, in each of E101 to E137, A in the compound represented by the formula (1) has a structure represented by the formula (2), and in each of E201 to E244, A in the compound represented by the formula (1) has a structure represented by the formula (3).

TABLE 2

| Compound No. | $R^1$ | $R^2$ | $R^4$ | $R^5$ |
|---|---|---|---|---|
| E101 | 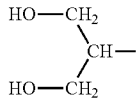 | 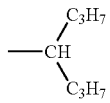 | H | H |
| E102 | 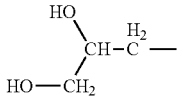 | 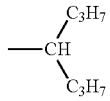 | H | H |
| E103 | 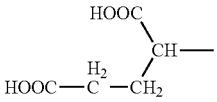 | 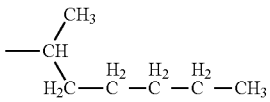 | H | H |
| E104 | 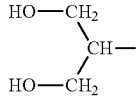 | 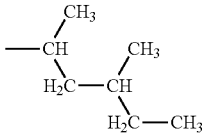 | H | H |
| E105 | 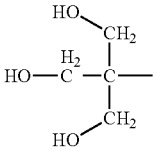 | 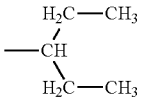 | H | H |
| E106 | 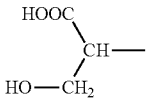 | 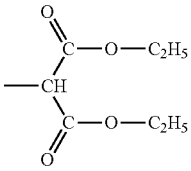 | H | H |
| E107 | 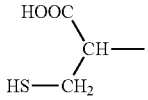 | 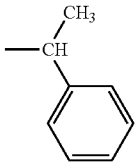 | H | H |
| E108 | 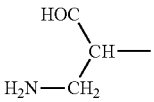 | 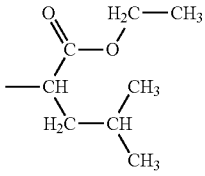 | H | H |
| E109 | 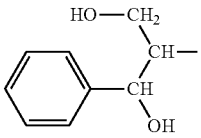 | 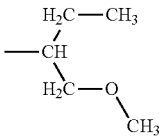 | H | H |

TABLE 2-continued
| Compound No. | $R^1$ | $R^2$ | $R^4$ | $R^5$ |
|---|---|---|---|---|
| E110 | 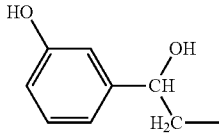 | 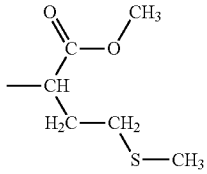 | H | H |
| E111 | 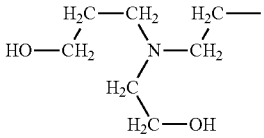 | 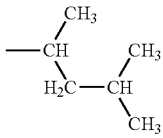 | H | H |
| E112 | 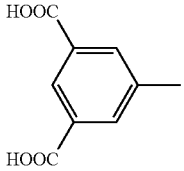 | 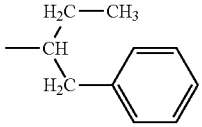 | H | H |
| E113 | 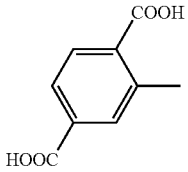 | 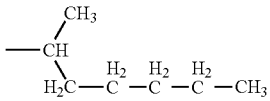 | H | H |
| E114 | 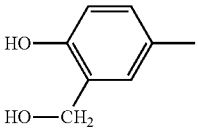 | 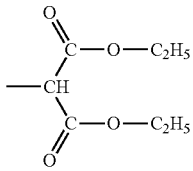 | H | H |
| E115 | 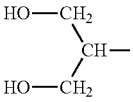 | 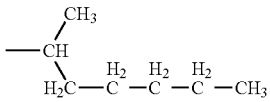 | $CF_3$ | $CF_3$ |
| E116 | 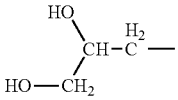 | 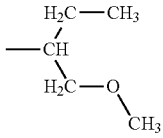 | 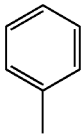 | 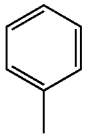 |
| E117 | 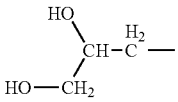 | 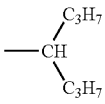 | $NO_2$ | $NO_2$ |
| E118 | 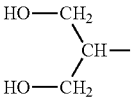 | 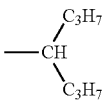 | CN | CN |
| E119 | 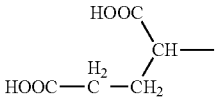 | 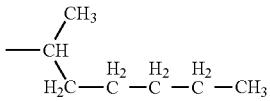 | $CH_3$ | $CH_3$ |

TABLE 2-continued
| Compound No. | $R^1$ | $R^2$ | $R^4$ | $R^5$ |
|---|---|---|---|---|
| E120 | 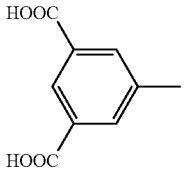 | 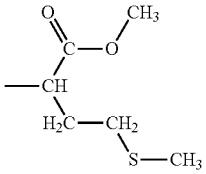 | Cl | Cl |
| E121 | 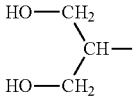 | $—(CH_2)_5CH_3$ | H | H |
| E122 | 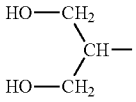 | $—(CH_2)_2O(CH_2)_2CH_3$ | H | H |
| E123 | 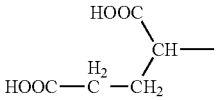 | $—(CH_2)_4CH_3$ | H | H |
| E124 | 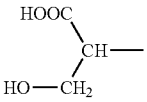 | $—(CH_2)_2S(CH_2)_2CH_3$ | H | H |
| E125 | 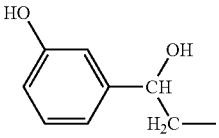 | $—(CH_2)_2NH(CH_2)_2CH_3$ | H | H |
| E126 | 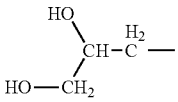 | 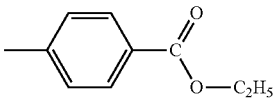 | H | H |
| E127 | 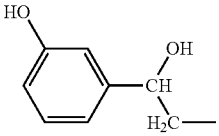 | 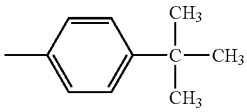 | H | H |
| E128 | 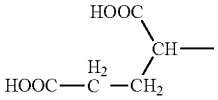 | 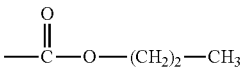 | H | H |
| E129 | 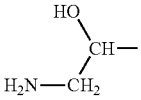 | 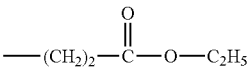 | H | H |
| E130 | 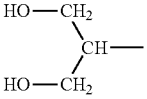 | 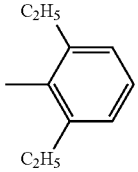 | H | H |
| E131 | 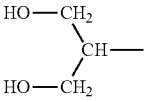 | 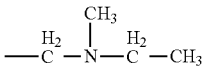 | H | H |

TABLE 2-continued
| Compound No. | $R^1$ | $R^2$ | $R^4$ | $R^5$ |
|---|---|---|---|---|
| E132 | 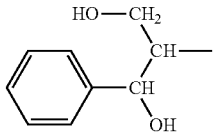 | 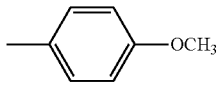 | H | H |
| E133 | 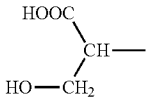 | 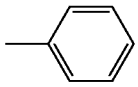 | H | H |
| E134 | 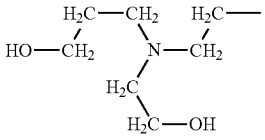 | 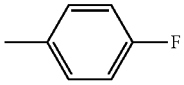 | CN | CN |
| E135 | 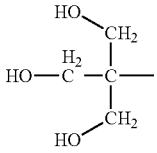 | 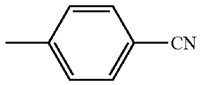 | H | H |
| E136 | 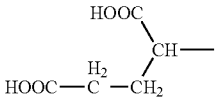 | 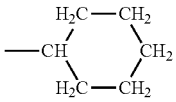 | $CF_3$ | $CF_3$ |
| E137 | 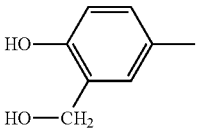 | 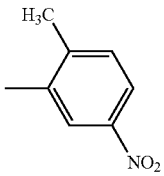 | H | H |

TABLE 3
| Compound No. | $R^1$ | $R^2$ | $R^6$ | $R^7$ | $R^8$ | $R^9$ | $R^{10}$ | $R^{11}$ | $R^{12}$ | $R^{13}$ |
|---|---|---|---|---|---|---|---|---|---|---|
| E201 | 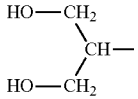 | 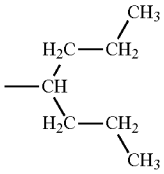 | H | H | H | H | H | H | H | H |
| E202 | 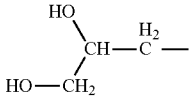 | 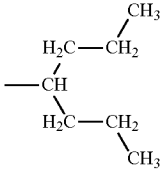 | H | H | H | H | H | H | H | H |
| E203 | 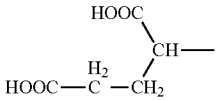 | 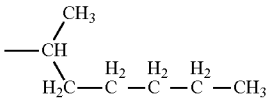 | H | H | H | H | H | H | H | H |
| E204 | 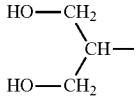 | 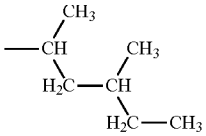 | H | H | H | H | H | H | H | H |
| E205 | 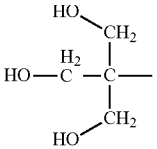 | 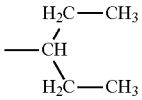 | H | H | H | H | H | H | H | H |
| E206 | 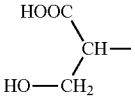 | 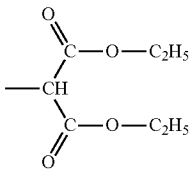 | H | H | H | H | H | H | H | H |

TABLE 3-continued
| Compound No. | $R^1$ | $R^2$ | $R^6$ | $R^7$ | $R^8$ | $R^9$ | $R^{10}$ | $R^{11}$ | $R^{12}$ | $R^{13}$ |
|---|---|---|---|---|---|---|---|---|---|---|
| E207 | 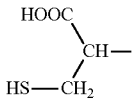 | 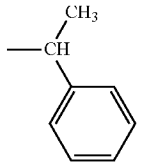 | H | H | H | H | H | H | H | H |
| E208 | 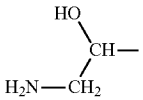 | 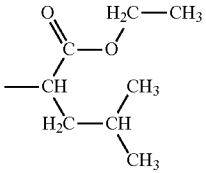 | H | H | H | H | H | H | H | H |
| E209 | 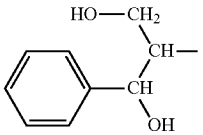 | 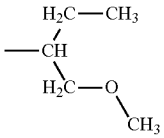 | H | H | H | H | H | H | H | H |
| E210 | 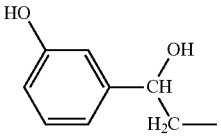 | 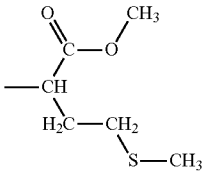 | H | H | H | H | H | H | H | H |
| E211 | 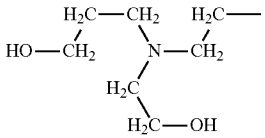 | 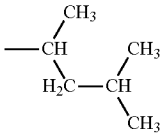 | H | H | H | H | H | H | H | H |
| E212 | 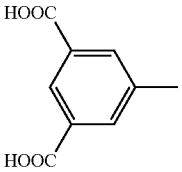 | 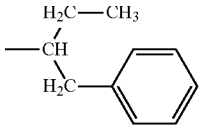 | H | H | H | H | H | H | H | H |

TABLE 3-continued
| Compound No. | $R^1$ | $R^2$ | $R^6$ | $R^7$ | $R^8$ | $R^9$ | $R^{10}$ | $R^{11}$ | $R^{12}$ | $R^{13}$ |
|---|---|---|---|---|---|---|---|---|---|---|
| E213 | 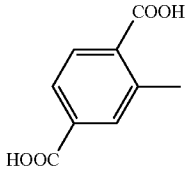 | 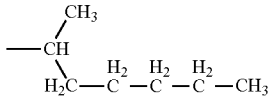 | H | H | H | H | H | H | H | H |
| E214 | 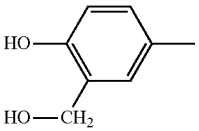 | 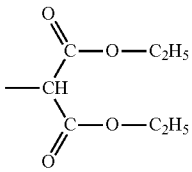 | H | H | H | H | H | H | H | H |
| E215 | 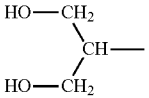 | 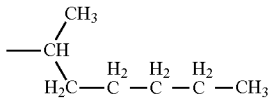 | H | H | H | H | H | H | H | H |
| E216 | 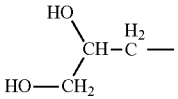 | 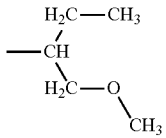 | H | H | H | H | H | H | H | H |
| E217 | 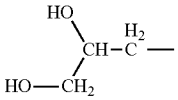 | 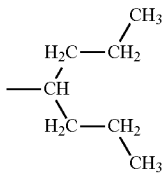 | H | H | H | H | H | H | H | H |
| E218 | 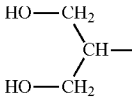 | 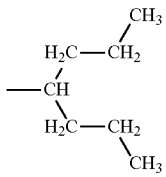 | H | H | H | H | H | H | H | H |

TABLE 3-continued
| Compound No. | $R^1$ | $R^2$ | $R^6$ | $R^7$ | $R^8$ | $R^9$ | $R^{10}$ | $R^{11}$ | $R^{12}$ | $R^{13}$ |
|---|---|---|---|---|---|---|---|---|---|---|
| E219 | 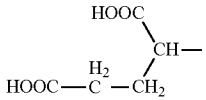 | 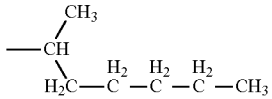 | H | H | H | H | H | H | H | H |
| E220 | 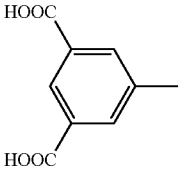 | 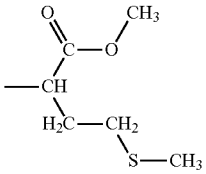 | H | H | H | H | H | H | H | H |
| E221 | 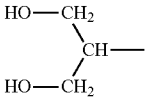 | $—(CH_2)_5CH_3$ | H | H | H | H | H | H | H | H |
| E222 | 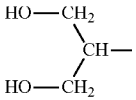 | $—(CH_2)_2O(CH_2)_2CH_3$ | H | H | H | H | H | H | H | H |
| E223 | 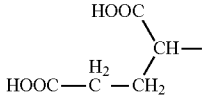 | $—(CH_2)_4CH_3$ | H | H | H | H | H | H | H | H |
| E224 | 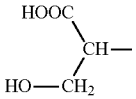 | $—(CH_2)_2S(CH_2)_2CH_3$ | H | F | H | H | H | H | H | H |
| E225 | 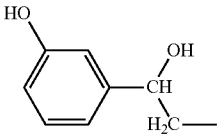 | $—(CH_2)_2NH(CH_2)_2CH_3$ | H | H | H | H | H | H | H | H |
| E226 | 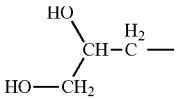 | 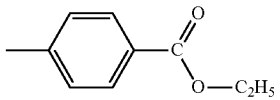 | H | H | H | H | H | H | H | H |

TABLE 3-continued
| Compound No. | $R^1$ | $R^2$ | $R^6$ | $R^7$ | $R^8$ | $R^9$ | $R^{10}$ | $R^{11}$ | $R^{12}$ | $R^{13}$ |
|---|---|---|---|---|---|---|---|---|---|---|
| E227 | 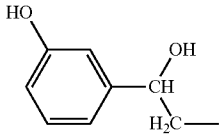 | 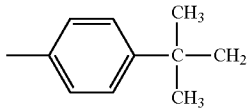 | H | H | H | H | H | H | H | H |
| E228 | 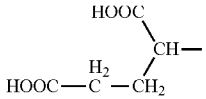 | 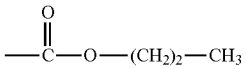 | H | H | H | H | H | H | H | H |
| E229 | 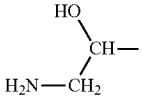 | 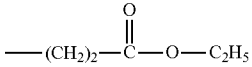 | H | H | H | H | H | H | H | H |
| E230 | 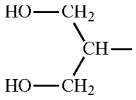 | 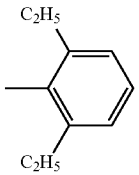 | H | H | H | H | H | H | H | H |
| E231 | 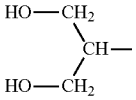 | 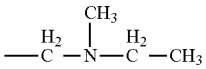 | H | H | H | H | H | H | H | H |
| E232 | 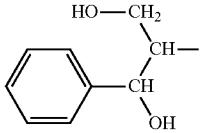 | 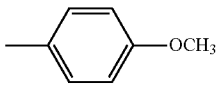 | H | H | $CF_3$ | H | H | $CF_3$ | H | H |
| E233 | 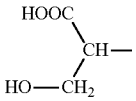 | 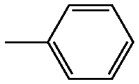 | H | H | H | H | H | H | H | H |

TABLE 3-continued
| Compound No. | $R^1$ | $R^2$ | $R^6$ | $R^7$ | $R^8$ | $R^9$ | $R^{10}$ | $R^{11}$ | $R^{12}$ | $R^{13}$ |
|---|---|---|---|---|---|---|---|---|---|---|
| E234 | 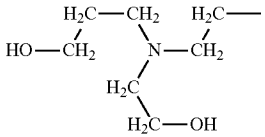 | 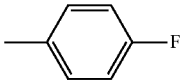 | Cl | Cl | Cl | Cl | Cl | Cl | Cl | Cl |
| E235 | 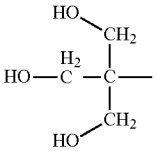 | 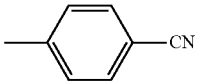 | H | H | H | H | H | H | H | H |
| E236 | 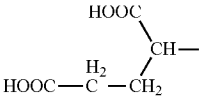 | 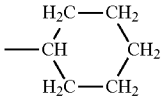 | H | Cl | Cl | H | H | Cl | Cl | H |
| E237 | 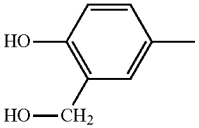 | 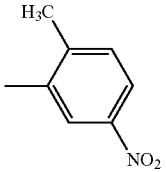 | 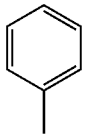 | H | H | 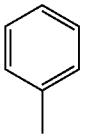 | 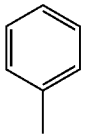 | H | H | 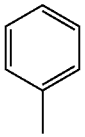 |
| E238 | 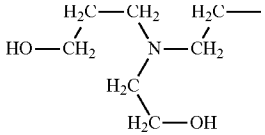 | 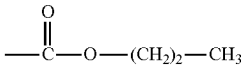 | H | $—CH_2C_3F_7$ | H | H | H | H | $—CH_2C_3F_7$ | H |
| E239 | 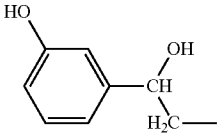 | $—(CH_2)_2O(CH_2)_2CH_3$ | H | 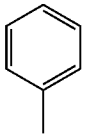 | H | H | H | H | 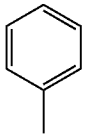 | H |

TABLE 3-continued
| Compound No. | $R^1$ | $R^2$ | $R^6$ | $R^7$ | $R^8$ | $R^9$ | $R^{10}$ | $R^{11}$ | $R^{12}$ | $R^{13}$ |
|---|---|---|---|---|---|---|---|---|---|---|
| E240 | 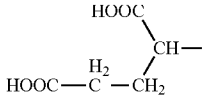 | $—(CH_2)_5CH_3$ | H | $NO_2$ | H | H | H | H | $NO_2$ | H |
| E241 | 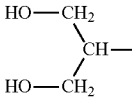 | 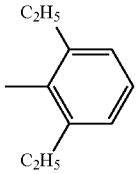 | H | CN | H | H | H | H | H | H |
| E242 | 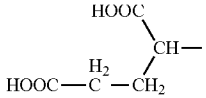 | 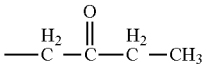 | $CH_3$ | $CH_3$ | $CH_3$ | $CH_3$ | $CH_3$ | $CH_3$ | $CH_3$ | $CH_3$ |
| E243 | 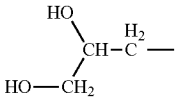 | $—(CH_2)_4CH_3$ | H | Cl | H | H | H | H | Cl | H |
| E244 | 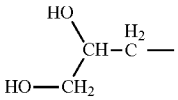 | 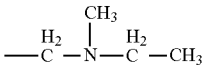 | H | CN | H | H | H | H | CN | H |

The identification of a compound or the like to be used in the present invention was performed by the following method.

Mass Spectrometry

A matrix-assisted laser desorption/ionization time-of-flight mass spectrometer (MALDI-TOF MS: ultraflex manufactured by Bruker Daltonics K.K.) was used. Conditions were as follows: acceleration voltage: 20 kV, mode: Reflector, and molecular weight standard: fullerene C60. A molecular weight was identified with the resultant peak top value.

[Photosensitive Layer]

The photosensitive layer containing the charge generating material and the hole transporting material is arranged on the undercoat layer.

The photosensitive layer containing the charge generating material and the hole transporting material comes in the following types: a photosensitive layer obtained by laminating a charge generating layer containing the charge generating material and a hole transporting layer containing the hole transporting material in this order from a support side (hereinafter sometimes referred to as "laminated photosensitive layer"); and a photosensitive layer obtained by incorporating the charge generating material and the hole transporting material into the same layer (hereinafter sometimes referred to as "single-layer photosensitive layer"). A plurality of the charge generating layers may be arranged, and a plurality of the hole transporting layers may also be arranged.

Examples of the charge generating material include an azo pigment, a perylene pigment, a quinone pigment, an indigoid pigment, a phthalocyanine pigment, and a perinone pigment. Of those, an azo pigment or a phthalocyanine pigment is preferred. Of the phthalocyanine pigments, oxytitanium phthalocyanine, chlorogallium phthalocyanine, or hydroxygallium phthalocyanine is preferred.

Examples of a binder resin to be used for the charge generating layer in the case where the photosensitive layer is the laminated photosensitive layer include: a polymer and copolymer of a vinyl compound, such as styrene, vinyl acetate, vinyl chloride, an acrylic acid ester, a methacrylic acid ester, vinylidene fluoride, or trifluoroethylene; polyvinyl alcohol; polyvinyl acetal; polycarbonate; polyester; polysulfone; polyphenylene oxide; polyurethane; a cellulose resin; a phenol resin; a melamine resin; a silicon resin; and an epoxy resin. Of those, polyester, polycarbonate, and polyvinyl acetal are preferred, and polyvinyl acetal is more preferred.

In addition, it is preferred that the weight-average molecular weight (Mw) of any such binder resin fall within the range of from 5,000 to 300,000.

In the charge generating layer, the mass ratio (charge generating material/binder resin) of the charge generating material to the binder resin falls within the range of preferably from 10/1 to 1/10, more preferably from 5/1 to 1/5.

The thickness of the charge generating layer is preferably 0.05 μm or more and 5 μm or less.

Examples of the hole transporting material include a polycyclic aromatic compound, a heterocyclic compound, a hydrazone compound, a styryl compound, a benzidine compound, a triarylamine compound, and triphenylamine. In addition, examples thereof also include a polymer having in its main chain or side chain a group resulting from any one of these compounds.

Examples of a binder resin to be used for the hole transporting layer in the case where the photosensitive layer is the laminated photosensitive layer include a polyester, a polycarbonate, a polymethacrylic acid ester, a polyarylate, a polysulfone, and a polystyrene. Of those, a polycarbonate and a polyarylate are preferred. In addition, it is preferred that the weight-average molecular weight (Mw) of any such binder resin fall within the range of from 10,000 to 300,000.

In the hole transporting layer, the mass ratio (hole transporting material/binder resin) of the hole transporting material to the binder resin falls within the range of preferably from 10/5 to 5/10, more preferably from 10/8 to 6/10.

Another layer, such as an electroconductive layer obtained by dispersing electroconductive particles made of a metal oxide, carbon black, or the like in a resin, or a second undercoat layer that does not contain the polymer to be used in the present invention, may be arranged between the support and the undercoat layer, or between the undercoat layer and the photosensitive layer.

In addition, a protective layer containing electroconductive particles or the hole transporting material and a binder resin may be arranged on the photosensitive layer (or in the case of the laminated photosensitive layer, the hole transporting layer). An additive, such as a lubricant, may be further incorporated into the protective layer. In addition, the resin (binder resin) itself of the protective layer may be provided with electroconductivity or a hole transporting property, and in this case, the electroconductive particles or the hole transporting material except the resin may not be incorporated into the protective layer. In addition, the binder resin of the protective layer may be a thermoplastic resin, or may be a curable resin that can be cured with heat, light, a radiation (e.g., an electron beam), or the like.

A method of forming each layer constituting the electrophotographic photosensitive member, such as the undercoat layer or the photosensitive layer, is preferably a method involving: applying a coating liquid obtained by dissolving and/or dispersing a material constituting each layer in a solvent; and drying and/or curing the resultant coating film to form the layer. A method of applying the coating liquid is, for example, an immersion application method (immersion coating method), a spray coating method, a curtain coating method, or a spin coating method. Of those, an immersion application method is preferred from the viewpoints of efficiency and productivity.

[Process Cartridge and Electrophotographic Apparatus]

FIGURE is a view for illustrating the schematic construction of an electrophotographic apparatus including a process cartridge 9 including the electrophotographic photosensitive member of the present invention.

In FIGURE, a drum-shaped electrophotographic photosensitive member 1 of the present invention is rotationally driven about a rotation axis 2 in a direction indicated by the arrow at a predetermined peripheral speed. The surface (peripheral surface) of the electrophotographic photosensitive member 1 is charged to a predetermined positive or negative potential by a charging unit 3 (e.g., a contact-type primary charger or a non-contact-type primary charger) in the course of its rotation. Next, the surface receives exposure light (image exposure light) 4 (e.g., laser light) from an exposing unit (image exposing unit) (not shown), such as slit exposure or laser beam scanning exposure. Thus, electrostatic latent images are sequentially formed on the surface of the electrophotographic photosensitive member 1.

Next, the formed electrostatic latent images are each developed with a toner of a developing unit 5 (e.g., a contact-type developing device or a non-contact-type developing machine). The resultant toner images are sequentially transferred onto a transfer material P (e.g., paper) by a transferring unit 6 (e.g., a transfer charger). The transfer material P is removed from a transfer material supplying portion (not shown) in synchronization with the rotation of the electrophotographic photosensitive member 1, and is fed to a gap between the electrophotographic photosensitive member 1 and the transferring unit 6.

The transfer material P onto which the toner images have been transferred is separated from the surface of the electrophotographic photosensitive member 1, and is introduced into a fixing unit 8 to undergo image fixation. Thus, the transfer material is printed out as a copied product (copy) to the outside of the electrophotographic apparatus.

The surface of the electrophotographic photosensitive member 1 after the transfer of the toner is subjected to the removal of a transfer residual toner by a cleaning unit 7 to be cleaned, and is subjected to an antistatic treatment by pre-exposure light from a pre-exposing unit (not shown). After that, the electrophotographic photosensitive member is repeatedly used in image formation.

A scorotron charger or a corotron charger utilizing corona discharge may be used as the charging unit 3, or a contact-type charger including a charging member of, for example, a roller shape, a blade shape, or a brush shape may be used.

In the present invention, the electrophotographic photosensitive member 1 and at least one unit selected from the group consisting of components such as the charging unit 3, the developing unit 5, and the cleaning unit 7 may be integrally combined to constitute a process cartridge. In addition, the process cartridge may be removably mounted onto the main body of an electrophotographic apparatus, such as a copying machine or a laser beam printer. For example, a cartridge is produced by integrally supporting at least one unit selected from the group consisting of the charging unit 3, the developing unit 5, and the cleaning unit 7 together with the electrophotographic photosensitive member 1. Then, the cartridge can be turned into a process cartridge 9 removably mounted onto the main body of the electrophotographic apparatus by using guiding units, such as rails 10 of the main body of the electrophotographic apparatus.

Now, the present invention is described in more detail by way of Examples. The term "part(s)" in Examples refers to "part(s) by mass".

First, a synthesis example of the imide compound represented by the formula (1) is described.

Synthesis Example 1

Under room temperature and in a stream of nitrogen, 21.8 g (100 mmol) of 1,2,4,5-pyromellitic dianhydride and 150 ml of dimethylacetamide were loaded into a 300-milliliter three-necked flask. A mixture of 5.8 g (50 mmol) of 4-heptylamine, 4.6 g (50 mmol) of 2-amino-1,3-propanediol, and 50 ml of dimethylacetamide was dropped to the contents while the contents were stirred. After the completion of the dropping, the resultant was heated to reflux for 6 hours. After the completion of the reaction, the container was cooled and the resultant was concentrated under reduced pressure. Ethyl acetate was added to the residue and then the mixture was filtered, followed by the purification of the filtrate by silica gel column chromatography. Further, the purified product was recrystallized with a mixture of ethyl acetate and hexane to provide 11.3 g of an imide compound represented by the formula (E101) shown in Table 2-1.

The measurement of the compound with a MALDI-TOF MS provided a peak top value of 388.

Synthesis Example 2

Under room temperature and in a stream of nitrogen, 39.2 g (100 mmol) of 3,4,9,10-perylene tetracarboxylic dianhydride and 150 ml of dimethylacetamide were loaded into a 300-milliliter three-necked flask. A mixture of 5.8 g (50 mmol) of 4-heptylamine, 4.6 g (50 mmol) of 2-amino-1,3-propanediol, and 50 ml of dimethylacetamide was dropped to the contents while the contents were stirred. After the completion of the dropping, the resultant was heated to reflux for 6 hours. After the completion of the reaction, the container was cooled and the resultant was concentrated under reduced pressure. Ethyl acetate was added to the residue and then the mixture was filtered, followed by the purification of the filtrate by silica gel column chromatography. Further, the purified product was recrystallized with a mixture of ethyl acetate and hexane to provide 16.0 g of an imide compound represented by the formula (E201) shown in Table 3-1.

The measurement of the compound with a MALDI-TOF MS provided a peak top value of 562.

The imide compound of the present invention except the imide compounds represented by the formulae (E101) and (E201) can also be synthesized by the same method as the above-mentioned method through the selection of a raw material corresponding to its structure. Next, the production and evaluation of an electrophotographic photosensitive member are described.

Example 1

An aluminum cylinder having a length of 260.5 mm and a diameter of 30 mm (JIS-A3003, aluminum alloy) was used as a support (electroconductive support).

Next, 50 parts of titanium oxide particles covered with oxygen-deficient tin oxide (powder resistivity: 120 Ω·cm, tin oxide coverage: 40%), 40 parts of a phenol resin (PRIOPHEN J-325, manufactured by DIC Corporation, resin solid content: 60%), and 55 parts of methoxypropanol were loaded into a sand mill using glass beads each having a diameter of 1 mm, and were subjected to a dispersion treatment for 3 hours to prepare a coating liquid for an electroconductive layer.

The average particle diameter of the titanium oxide particles covered with oxygen-deficient tin oxide in the coating liquid for an electroconductive layer was measured through the use of a particle size distribution meter manufactured by Horiba, Ltd. (trade name: CAPA700) and tetrahydrofuran serving as a dispersion medium at a number of revolutions of 5,000 rpm by a centrifugal sedimentation method. As a result, the average particle diameter was 0.30 μm.

The coating liquid for an electroconductive layer was applied onto the support by immersion, and the resultant coating film was dried and thermally cured for 30 minutes at 160° C. to form an electroconductive layer having a thickness of 18 μm.

Next, 4 parts of the compound (E101) obtained in Synthesis Example 1, 1 part of the resin represented by B23 in Table 1, and 0.001 part of dioctyltin laurylate were dissolved in a mixed solvent of 60 parts of methoxypropanol and 60 parts of tetrahydrofuran. A crosslinking agent 1 serving as an isocyanate-based crosslinking agent corresponding to a solid content of 6 parts (trade name: BL3575: manufactured by Sumika Bayer Urethane Co., Ltd.) was added to the solution. Thus, a coating liquid for an undercoat layer was prepared. $R^{304}$ in the formula (S-1) serving as the characteristic moiety of the resin B23 represents a hydrogen atom.

The coating liquid for an undercoat layer was applied onto the electroconductive layer by immersion, and the resultant coating film was heated for 30 minutes at 160° C. to evaporate the solvent, and to cure the coating film. Thus, an undercoat layer having a thickness of 0.85 μm was formed.

Next, a hydroxygallium phthalocyanine crystal (charge generating material) of a crystal form having peaks at Bragg angles (2θ±0.20) in CuKα characteristic X-ray diffraction of 7.5°, 9.9°, 12.5°, 16.3°, 18.6°, 25.1°, and 28.3° was prepared. 10 Parts of the hydroxygallium phthalocyanine crystal, 5 parts of polyvinyl butyral (trade name: S-LEC BX-1, manufactured by Sekisui Chemical Co., Ltd.), and 250 parts of cyclohexanone were loaded into a sand mill using glass beads each having a diameter of 1 mm, and the mixture was subjected to a dispersion treatment for 2 hours. Next, 250 parts of ethyl acetate was added to the resultant to prepare a coating liquid for a charge generating layer.

The coating liquid for a charge generating layer was applied onto the undercoat layer by immersion to form a coating film, and the resultant coating film was dried for 10 minutes at 95° C. to form a charge generating layer having a thickness of 0.2 μm.

Next, a coating liquid for a hole transporting layer was prepared by dissolving 6 parts of an amine compound (hole transporting material) represented by the formula (5), 2 parts of an amine compound (hole transporting material) represented by the formula (6), and 10 parts of a polyester resin having structural units represented by the formula (7) and the formula (8) at a ratio of 5/5 and having a weight-average molecular weight (Mw) of 100,000 in a mixed solvent of 40 parts of dimethoxymethane and 60 parts of chlorobenzene.

(5)

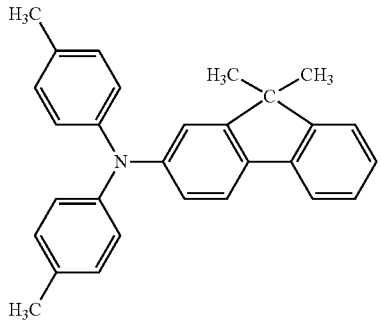

(6)

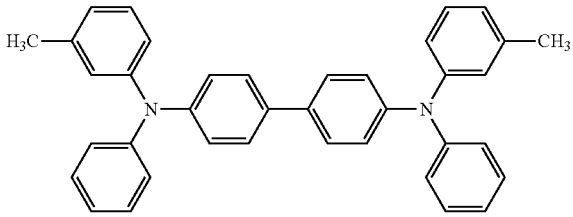

(7)

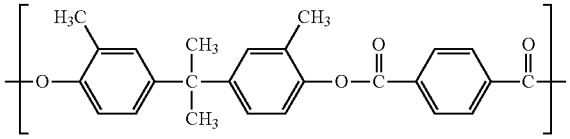

(8)

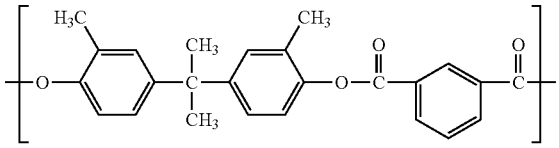

The coating liquid for a hole transporting layer was applied onto the charge generating layer by immersion, and the resultant coating film was dried for 40 minutes at 120° C. to form a hole transporting layer having a thickness of 15 μm.

Thus, an electrophotographic photosensitive member having, on the support, the electroconductive layer, the undercoat layer, the charge generating layer, and the hole transporting layer was produced.

The produced electrophotographic photosensitive member was mounted onto a reconstructed apparatus of a laser beam printer manufactured by Canon Inc. (trade name: LBP-2510) (primary charging: roller contact DC charging, process speed: 180 mm/sec, laser exposure) under an environment having a temperature of 23° C. and a humidity of 50% RH. Then, the evaluations of its surface potentials at an initial stage and after image output on 20,000 sheets were performed. Details about the foregoing are as described below.

(Evaluation of Surface Potential)

The process cartridge for a cyan color of the laser beam printer was reconstructed, and a potential probe (model 6000B-8: manufactured by Trek Japan) was mounted at its developing position. Next, the potential of the central portion of the electrophotographic photosensitive member was measured with a surface potentiometer (model 344: manufactured by Trek Japan). In addition, the light quantity of image exposure was set so that the dark potential (Vd) and light potential (Vl) of the electrophotographic photosensitive member became −600 V and −150 V, respectively.

Subsequently, the process cartridge for a cyan color of the laser beam printer was mounted with the produced electrophotographic photosensitive member, and the process cartridge was mounted onto the station of the cyan process cartridge to output an image.

After the completion of the image output, the potential was measured with the potential probe and the potentiometer again.

Examples 2 to 44

Photosensitive members were each produced in the same manner as in Example 1 except that the kinds and parts by mass of the exemplified compound, the crosslinking agent, and the resin were changed as shown in Table 4, and the members were each evaluated in the same manner as in Example 1. The results are shown in Table 4.

A crosslinking agent 2 is an isocyanate-based crosslinking agent (trade name: DESMODUR BL3175, manufactured by Sumika Bayer Urethane Co., Ltd. (solid content: 75%)). A crosslinking agent 3 is a butylated melamine-based crosslinking agent (trade name: SUPER BECKAMINE J821-60, manufactured by DIC Corporation (solid content: 60%)). A crosslinking agent 4 is 2,4,6-tris[bis(methoxymethyl) amino]-1,3,5-triazine (manufactured by Tokyo Chemical Industry Co., Ltd.).

Comparative Example 1

A photosensitive member was produced in the same manner as in Example 41 except that a compound (9) represented by the formula (9) was used instead of the imide compound E121, and the member was evaluated in the same manner as in Example 41. The results are shown in Table 4.

(9)

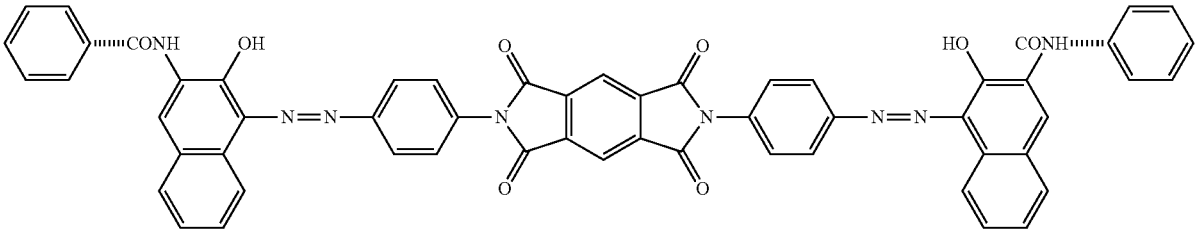

Comparative Example 2

A photosensitive member was produced in the same manner as in Example 41 except that a compound (10) represented by the formula (10) was used instead of the imide compound E121, and the member was evaluated in the same manner as in Example 41. The results are shown in Table 4.

(10)

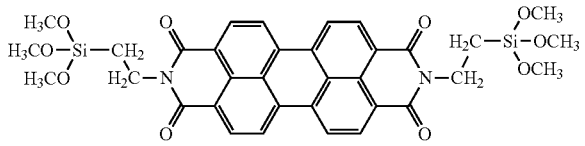

TABLE 4

| Example No. | Imide compound | Part(s) by mass | Crosslinking agent | Part(s) by mass (solid content) | Resin | Part(s) by mass (solid content) | Fluctuation in potential |
|---|---|---|---|---|---|---|---|
| 1 | E101 | 4 | Crosslinking agent 1 | 6 | B23 | 1 | 50 |
| 2 | E102 | 4 | Crosslinking agent 2 | 6 | B23 | 1 | 55 |
| 3 | E103 | 4 | Crosslinking agent 3 | 6 | B1 | 1 | 50 |
| 4 | E104 | 4 | Crosslinking agent 4 | 6 | B17 | 1 | 53 |
| 5 | E105 | 4 | Crosslinking agent 1 | 6 | B1 | 1 | 50 |
| 6 | E106 | 4 | Crosslinking agent 1 | 6 | B1 | 1 | 55 |
| 7 | E107 | 4 | Crosslinking agent 1 | 6 | B1 | 1 | 51 |
| 8 | E108 | 4 | Crosslinking agent 1 | 6 | B1 | 1 | 52 |
| 9 | E101 | 4 | Crosslinking agent 1 | 7 | B1 | 1 | 55 |
| 10 | E101 | 5 | Crosslinking agent 1 | 1.5 | B1 | 1 | 48 |
| 11 | E201 | 4 | Crosslinking agent 1 | 6 | B1 | 1 | 40 |
| 12 | E202 | 4 | Crosslinking agent 2 | 6 | B23 | 1 | 40 |
| 13 | E203 | 4 | Crosslinking agent 3 | 6 | B1 | 1 | 45 |
| 14 | E204 | 4 | Crosslinking agent 4 | 6 | B23 | 1 | 40 |
| 15 | E205 | 4 | Crosslinking agent 1 | 6 | B1 | 1 | 40 |
| 16 | E206 | 4 | Crosslinking agent 1 | 6 | B1 | 1 | 45 |
| 17 | E207 | 4 | Crosslinking agent 1 | 6 | B1 | 1 | 40 |
| 18 | E208 | 4 | Crosslinking agent 1 | 6 | B1 | 1 | 41 |
| 19 | E201 | 4 | Crosslinking agent 1 | 7 | B1 | 1 | 45 |
| 20 | E201 | 5 | Crosslinking agent 1 | 1.5 | B1 | 1 | 38 |
| 21 | E121 | 4 | Crosslinking agent 1 | 6 | B1 | 1 | 70 |
| 22 | E122 | 4 | Crosslinking agent 1 | 6 | B1 | 1 | 71 |
| 23 | E123 | 4 | Crosslinking agent 1 | 6 | B1 | 1 | 75 |
| 24 | E124 | 4 | Crosslinking agent 1 | 6 | B1 | 1 | 70 |
| 25 | E125 | 4 | Crosslinking agent 1 | 6 | B1 | 1 | 70 |
| 26 | E126 | 5 | Crosslinking agent 1 | 6 | B1 | 1 | 73 |
| 27 | E127 | 4 | Crosslinking agent 1 | 6 | B1 | 1 | 75 |
| 28 | E128 | 4 | Crosslinking agent 1 | 6 | B1 | 1 | 70 |
| 29 | E129 | 4 | Crosslinking agent 1 | 6 | B1 | 1 | 72 |
| 30 | E130 | 4 | Crosslinking agent 1 | 6 | B1 | 1 | 70 |
| 31 | E221 | 4 | Crosslinking agent 1 | 6 | B1 | 1 | 61 |
| 32 | E222 | 4 | Crosslinking agent 1 | 6 | B1 | 1 | 60 |
| 33 | E223 | 4 | Crosslinking agent 1 | 6 | B1 | 1 | 65 |
| 34 | E224 | 4 | Crosslinking agent 1 | 6 | B1 | 1 | 60 |
| 35 | E225 | 4 | Crosslinking agent 1 | 6 | B1 | 1 | 62 |
| 36 | E226 | 4 | Crosslinking agent 1 | 6 | B1 | 1 | 62 |
| 37 | E227 | 4 | Crosslinking agent 1 | 6 | B1 | 1 | 65 |
| 38 | E228 | 4 | Crosslinking agent 1 | 6 | B1 | 1 | 60 |
| 39 | E229 | 4 | Crosslinking agent 1 | 6 | B1 | 1 | 60 |
| 40 | E230 | 4 | Crosslinking agent 1 | 6 | B1 | 1 | 61 |
| 41 | E121 | 4 | Crosslinking agent 1 | 6 | None | — | 83 |

TABLE 4-continued

| Example No. | Imide compound | Part(s) by mass | Crosslinking agent | Part(s) by mass (solid content) | Resin | Part(s) by mass (solid content) | Fluctuation in potential |
|---|---|---|---|---|---|---|---|
| 42 | E122 | 4 | Crosslinking agent 1 | 6 | None | — | 85 |
| 43 | E221 | 4 | Crosslinking agent 1 | 6 | None | — | 81 |
| 44 | E222 | 4 | Crosslinking agent 1 | 6 | None | — | 80 |
| Comparative Example 1 | Compound (9) | 4 | Crosslinking agent 1 | 6 | None | — | 120 |
| Comparative Example 2 | Compound (10) | 4 | Crosslinking agent 1 | 6 | None | — | 115 |

As is apparent from the foregoing, the electrophotographic photosensitive member of the present invention can be suppressed in fluctuation in potential even after output on a large number of sheets as compared with a related-art electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-128103, filed Jun. 25, 2015 which is hereby incorporated by reference herein in its entirety.

What is claimed is:

1. An electrophotographic photosensitive member, comprising:

a support;

an undercoat layer formed on the support; and a photosensitive layer formed on the undercoat layer, wherein the undercoat layer contains a polymer of a composition containing a crosslinking agent, a resin having a polymerizable functional group and a compound represented by formula (1):

Formula (1)

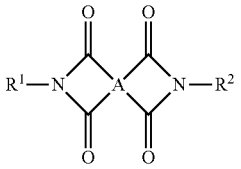

where $R^1$ represents a substituted or unsubstituted alkyl group having 1 to 6 carbon atoms in a main chain thereof, or a substituted or unsubstituted aryl group, the alkyl group or the aryl group having 2 or more polymerizable functional groups, and the polymerizable functional groups each comprise a hydroxy group, a thiol group, an amino group, or a carboxyl group;

$R^2$ represents a substituted or unsubstituted alkyl group having 1 to 6 carbon atoms in a main chain thereof, a group derived by substituting at least one $CH_2$ in a main chain of a substituted or unsubstituted alkyl group having 3 to 6 carbon atoms in the main chain with an oxygen atom, a group derived by substituting at least one $CH_2$ in a main chain of a substituted or unsubstituted alkyl group having 3 to 6 carbon atoms in the main chain with a sulfur atom, a group derived by substituting at least one $CH_2$ in a main chain of a substituted or unsubstituted alkyl group having 3 to 6 carbon atoms in the main chain with $NR^3$, a group derived by substituting at least one $CH_2$ in a main chain of a substituted or unsubstituted alkyl group having 2 to 6 carbon atoms in the main chain with a carbonyl group, a group derived by substituting at least one $C_2H_4$ in a main chain of a substituted or unsubstituted alkyl group having 3 to 6 carbon atoms in the main chain with COO, a substituted or unsubstituted cyclic alkyl group having 3 to 6 carbon atoms in a main chain thereof, or a substituted or unsubstituted aryl group;

$R^3$ represents a hydrogen atom, or a substituted or unsubstituted alkyl group having 1 to 6 carbon atoms in a main chain thereof;

a substituent of each of the alkyl group, the group derived by substituting at least one $CH_2$ in the main chain of an alkyl group with an oxygen atom, a sulfur atom, $NR^3$, or a carbonyl group, the group derived by substituting at least one $C_2H_4$ in the main chain of an alkyl group with COO, and the cyclic alkyl group comprises an alkyl group having 1 to 6 carbon atoms, benzyl group, alkoxycarbonyl group, or phenyl group that may be further substituted;

a substituent of the aryl group comprises a halogen atom, a cyano group, a nitro group, or an alkyl group, alkoxy group, or alkoxycarbonyl group having 1 to 6 carbon atoms that may be further substituted; and A represents a structure represented by formula (2) or formula (3):

Formula (2)

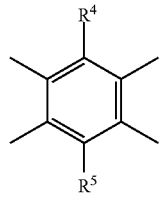

Formula (3)

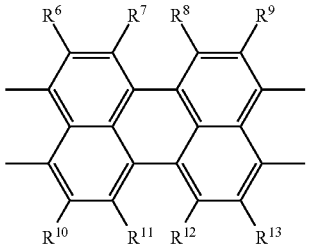

where $R^4$ to $R^{13}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group, and a mass ratio between the compound represented by formula (1), and at least one of the crosslinking agent and the resin having a polymerizable functional group is from 100:50 to 100:250.

2. An electrophotographic photosensitive member according to claim 1, wherein the alkyl group represented by $R^2$ comprises a branched alkyl group.

3. An electrophotographic photosensitive member according to claim 1, wherein the crosslinking agent comprises one of an isocyanate compound having one of an isocyanate group and a blocked isocyanate group, and an amine compound having one of an N-methylol group and an alkyl-etherified N-methylol group.

4. A process cartridge, comprising:

an electrophotographic photosensitive member; and at least one unit selected from the group consisting of a charging unit, a developing unit, and a cleaning unit, the process cartridge integrally supporting the electrophotographic photosensitive member and the at least one unit, the process cartridge being removably mounted onto an electrophotographic apparatus, wherein the electrophotographic photosensitive member comprises:

a support;

an undercoat layer formed on the support; and a photosensitive layer formed on the undercoat layer, the undercoat layer containing a crosslinking agent, a resin having a polymerizable functional group and a polymer of a composition containing a compound represented by formula (1):

Formula (1)

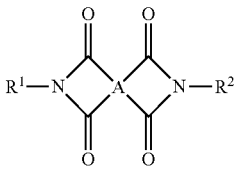

where $R^1$ represents a substituted or unsubstituted alkyl group having 1 to 6 carbon atoms in a main chain thereof, or a substituted or unsubstituted aryl group, the alkyl group or the aryl group having 2 or more polymerizable functional groups, and the polymerizable functional groups each comprise a hydroxy group, a thiol group, an amino group, or a carboxyl group;

$R^2$ represents a substituted or unsubstituted alkyl group having 1 to 6 carbon atoms in a main chain thereof, a group derived by substituting at least one $CH_2$ in a main chain of a substituted or unsubstituted alkyl group having 3 to 6 carbon atoms in the main chain with an oxygen atom, a group derived by substituting at least one $CH_2$ in a main chain of a substituted or unsubstituted alkyl group having 3 to 6 carbon atoms in the main chain with a sulfur atom, a group derived by substituting at least one $CH_2$ in a main chain of a substituted or unsubstituted alkyl group having 3 to 6 carbon atoms in the main chain with $NR^3$, a group derived by substituting at least one $CH_2$ in a main chain of a substituted or unsubstituted alkyl group having 2 to 6 carbon atoms in the main chain with a carbonyl group, a group derived by substituting at least one $C_2H_4$ in a main chain of a substituted or unsubstituted alkyl group having 3 to 6 carbon atoms in the main chain with COO, a substituted or unsubstituted cyclic alkyl group having 3 to 6 carbon atoms in a main chain thereof, or a substituted or unsubstituted aryl group;

$R^3$ represents a hydrogen atom, or a substituted or unsubstituted alkyl group having 1 to 6 carbon atoms in a main chain thereof;

a substituent of each of the alkyl group, the group derived by substituting at least one $CH_2$ in the main chain of an alkyl group with an oxygen atom, a sulfur atom, $NR^3$, or a carbonyl group, the group derived by substituting at least one $C_2H_4$ in the main chain of an alkyl group with COO, and the cyclic alkyl group comprises an alkyl group having 1 to 6 carbon atoms, benzyl group, alkoxycarbonyl group, or phenyl group that may be further substituted;

a substituent of the aryl group comprises a halogen atom, a cyano group, a nitro group, or an alkyl group, alkoxy group, or alkoxycarbonyl group having 1 to 6 carbon atoms that may be further substituted; and A represents a structure represented by formula (2) or formula (3):

Formula (2)

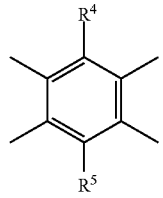

Formula (3)

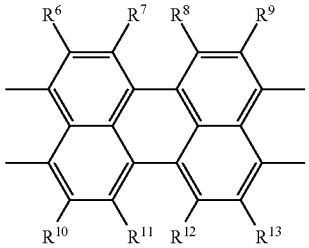

where $R^4$ to $R^{13}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group, and a mass ratio between the compound represented by formula (1), and at least one of the crosslinking agent and the resin having a polymerizable functional group is from 100:50 to 100:250.

5. An electrophotographic apparatus, comprising at least:

an electrophotographic photosensitive member;

a charging unit;

an exposing unit;

a developing unit; and a transferring unit, wherein the electrophotographic photosensitive member comprises:

a support;

an undercoat layer formed on the support; and a photosensitive layer formed on the undercoat layer, the undercoat layer containing a crosslinking agent, a resin having a polymerizable functional group and a polymer of a composition containing a compound represented by formula (1):

Formula (1)

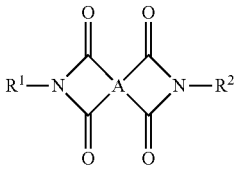

where $R^1$ represents a substituted or unsubstituted alkyl group having 1 to 6 carbon atoms in a main chain thereof, or a substituted or unsubstituted aryl group, the alkyl group or the aryl group having 2 or more polymerizable functional groups, and the polymerizable functional groups each comprise a hydroxy group, a thiol group, an amino group, or a carboxyl group;

$R^2$ represents a substituted or unsubstituted alkyl group having 1 to 6 carbon atoms in a main chain thereof, a group derived by substituting at least one $CH_2$ in a main chain of a substituted or unsubstituted alkyl group having 3 to 6 carbon atoms in the main chain with an oxygen atom, a group derived by substituting at least one $CH_2$ in a main chain of a substituted or unsubstituted alkyl group having 3 to 6 carbon atoms in the main chain with a sulfur atom, a group derived by substituting at least one $CH_2$ in a main chain of a substituted or unsubstituted alkyl group having 3 to 6 carbon atoms in the main chain with $NR^3$, a group derived by substituting at least one $CH_2$ in a main chain of a substituted or unsubstituted alkyl group having 2 to 6 carbon atoms in the main chain with a carbonyl group, a group derived by substituting at least one $C_2H_4$ in a main chain of a substituted or unsubstituted alkyl group having 3 to 6 carbon atoms in the main chain with COO, a substituted or unsubstituted cyclic alkyl group having 3 to 6 carbon atoms in a main chain thereof, or a substituted or unsubstituted aryl group;

$R^3$ represents a hydrogen atom, or a substituted or unsubstituted alkyl group having 1 to 6 carbon atoms in a main chain thereof;

a substituent of each of the alkyl group, the group derived by substituting at least one $CH_2$ in the main chain of an alkyl group with an oxygen atom, a sulfur atom, $NR^3$, or a carbonyl group, the group derived by substituting at least one $C_2H_4$ in the main chain of an alkyl group with COO, and the cyclic alkyl group comprises an alkyl group having 1 to 6 carbon atoms, benzyl group, alkoxycarbonyl group, or phenyl group that may be further substituted;

a substituent of the aryl group comprises a halogen atom, a cyano group, a nitro group, or an alkyl group, alkoxy group, or alkoxycarbonyl group having 1 to 6 carbon atoms that may be further substituted; and A represents a structure represented by formula (2) or formula (3):

Formula (2)

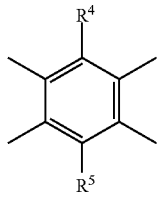

Formula (3)

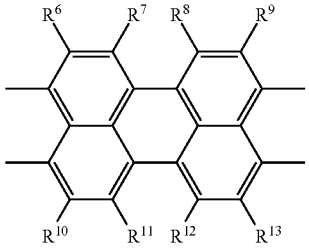

where $R^4$ to $R^{13}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group, and a mass ratio between the compound represented by formula (1), and at least one of the crosslinking agent and the resin having a polymerizable functional group is from 100:50 to 100:250.

* * * * *